US008201815B2

(12) United States Patent
Sasahara et al.

(10) Patent No.: US 8,201,815 B2
(45) Date of Patent: Jun. 19, 2012

(54) SHEET FOLDING APPARATUS, IMAGE FORMING APPARATUS USING THE SAME, AND SHEET FOLDING METHOD

(75) Inventors: Katsuya Sasahara, Shizuoka-Ken (JP); Shinichiro Mano, Kanagawa-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 414 days.

(21) Appl. No.: 12/612,427

(22) Filed: Nov. 4, 2009

(65) Prior Publication Data

US 2010/0119276 A1 May 13, 2010

Related U.S. Application Data

(60) Provisional application No. 61/114,007, filed on Nov. 12, 2008, provisional application No. 61/150,279, filed on Feb. 5, 2009.

(51) Int. Cl.
*B31F 1/10* (2006.01)

(52) U.S. Cl. ..... 270/45; 270/32; 270/58.07

(58) Field of Classification Search ..... 270/32, 270/45, 51, 58.07; 493/406, 407, 442, 454
See application file for complete search history.

(56) References Cited

U.S. PATENT DOCUMENTS

| | | | | |
|---|---|---|---|---|
| 7,678,038 | B1 * | 3/2010 | Stieber et al. | 493/442 |
| 2007/0017397 | A1 | 1/2007 | Kamata et al. | |
| 2009/0221411 | A1 * | 9/2009 | Endo | 493/407 |
| 2011/0103919 | A1 * | 5/2011 | Furuhashi et al. | 412/1 |

FOREIGN PATENT DOCUMENTS

| | | | |
|---|---|---|---|
| JP | 11-348451 | A | 12/1999 |
| JP | 2002-68577 | A | 3/2002 |
| JP | 2002-145516 | A | 5/2002 |
| JP | 2002-348032 | A | 12/2002 |
| JP | 2003-2525 | A | 1/2003 |
| JP | 2003-182928 | | 7/2003 |
| JP | 2003-276937 | A | 10/2003 |
| JP | 2006-285079 | A | 10/2006 |

* cited by examiner

*Primary Examiner* — Leslie A Nicholson, III
(74) *Attorney, Agent, or Firm* — Patterson & Sheridan, LLP

(57) ABSTRACT

A sheet folding apparatus includes a fold unit which folds a center of a sheet bundle to form a fold line, and a reinforce roller which moves along the fold line while applying pressure to the fold line to reinforce the fold line. The reinforce roller includes plural sub-rollers which are concentrically coupled to each other in a rotation axis direction, and the respective sub-rollers apply different pressures to the fold line.

20 Claims, 19 Drawing Sheets

Y-Y' CROSS-SECTION

Z-Z' CROSS-SECTION

AT MOVEMENT OF ROLLER UNIT
(AT FOLD LINE REINFORCING OPERATION)

ROLLER UNIT HOME POSITION

X-X' CROSS-SECTION

Y-Y' CROSS-SECTION

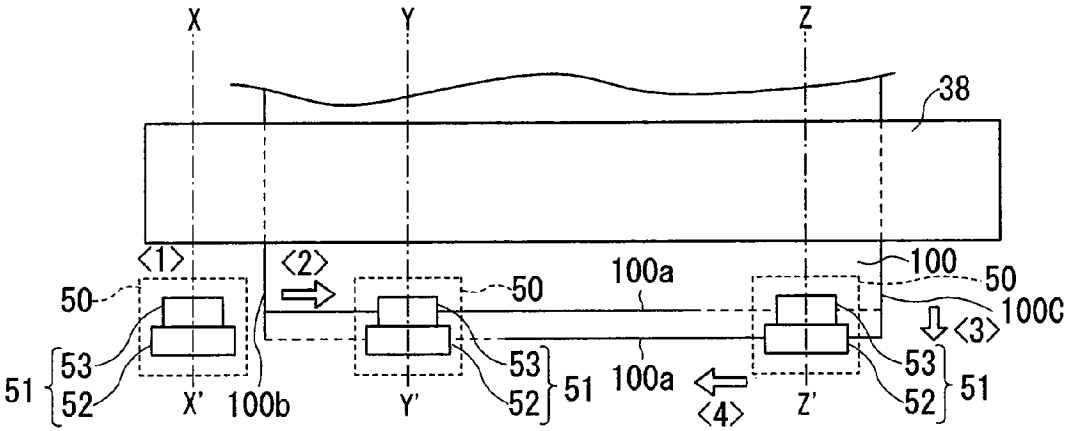
FIG. 12A
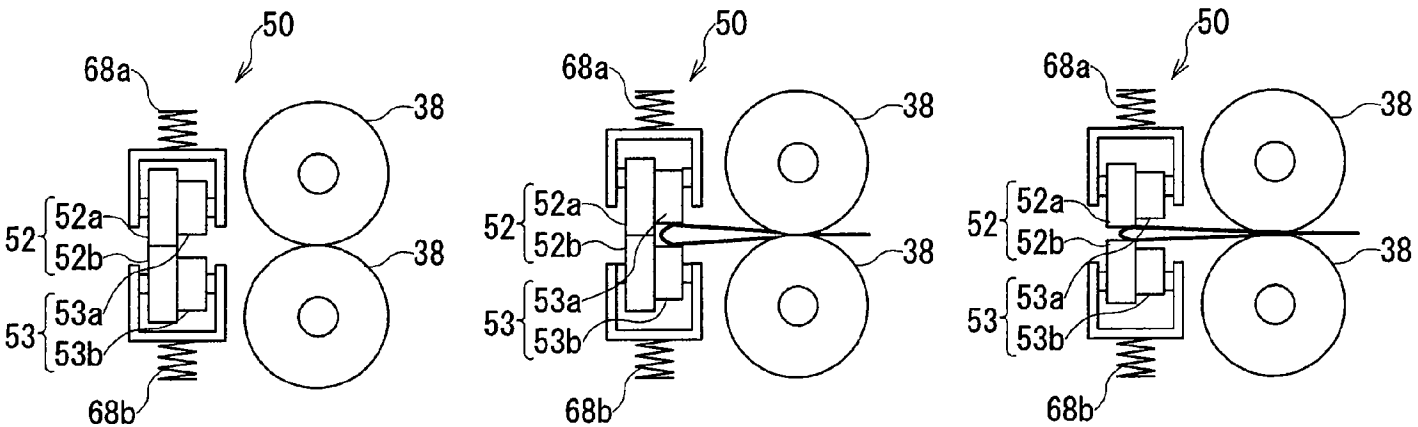
X-X' CROSS-SECTION
FIG. 12B
Y-Y' CROSS-SECTION
FIG. 12C
Z-Z' CROSS-SECTION
FIG. 12D

X-X' CROSS-SECTION

SECOND ROLLER
(MEMBER HAVING SMALL ELASTIC MODULUS)
REINFORCES FOLD LINE

Y-Y' CROSS-SECTION

FIRST ROLLER
(MEMBER HAVING LARGE ELASTIC MODULUS)
REINFORCES FOLD LINE

Z-Z' CROSS-SECTION

SHEET FOLDING APPARATUS, IMAGE FORMING APPARATUS USING THE SAME, AND SHEET FOLDING METHOD

CROSS-REFERENCE TO RELATED APPLICATIONS

This application is based upon and claims the benefit of priority from: U.S. provisional applications 61/114,007 filed on Nov. 12, 2008, and 61/150,279 filed on Feb. 5, 2009, the entire contents of each of which are incorporated herein by reference.

TECHNICAL FIELD

The present invention relates to a sheet folding apparatus, an image forming apparatus using the same, and a sheet folding method, and particular to a sheet folding apparatus to reinforce a fold line, an image forming apparatus using the same, and a sheet folding method.

BACKGROUND

Hitherto, there is a sheet finisher which is placed downstream of an image forming apparatus, such as a copier, a printer or an MFP (Multi-Function Peripheral), and performs finishing, such as punching or stitching, on a printed sheet.

A recent sheet finisher has multiple functions, and a sheet folding apparatus has appeared, which has, in addition to punching and stitching functions, a folding function to fold a part of a sheet, and a saddle-stitching and folding function to staple the center of a sheet and then to fold the sheet at the center.

In the sheet finisher having the saddle-stitching and folding function, it becomes possible to form a booklet (to bind a book) from a plurality of printed sheets.

In the saddle-stitching and folding, after the center of sheets is stitched with staples or the like, a fold line is formed on the stitched part by a pair of rollers called fold rollers. A plate-like member called a fold blade is applied to the stitched part of the sheet bundle, and presses into a nip of the fold roller pair to form the fold line on the sheet bundle.

However, when the number of sheets is large, or the sheet bundle includes a thick sheet, an excellent fold line is not necessarily formed. To cope with this issue, JP-A 2003-182928 discloses a technique d in which a roller called a reinforce roller is additionally provided, and the fold line formed by the fold rollers is reinforced by the reinforce roller.

The reinforce roller moves along the fold line of the sheet bundle pressed out from the fold roller, and reinforces the fold line by the pressure applied to the fold line by the reinforce roller.

As the pressure of the reinforce roller becomes large, a more excellent fold line can be formed. Especially, when the number of sheets is large and the sheet bundle is thick, a large pressure is required.

On reinforcing the fold line, the reinforce roller moves from the outside area of the sheet bundle to the sheet bundle so as to climb over the sheet bundle at the edge of the sheet bundle, and then moves along the fold line of the sheet bundle.

When the reinforce roller climbs over the edge of the sheet bundle, and when the pressure of the reinforce roller is excessively high, there occurs an undesirable phenomenon that the reinforce roller stops at the edge of the sheet bundle, or damages the edge of the sheet bundle. Besides, when the pressure of the reinforce roller is high, an un-neglectable impact sound can occur when the reinforce roller climbs over the edge of the sheet bundle or drops to the outside area of the sheet bundle. These undesirable phenomenon occurred at the edge of the sheet bundle as stated above becomes serious as the sheet bundle becomes thick or the pressure of the reinforce roller becomes high. This contradicts the request that in order to obtain an excellent fold line, as the sheet bundle becomes thick, the pressure of the reinforce roller must be made high.

SUMMARY

The present invention is made in view of the above circumstances, and it is an object to provide a sheet folding apparatus in which an excellently reinforced fold line can be obtained irrespective of a thickness of a sheet bundle and without damaging the sheet bundle, an image forming apparatus using the same, and a sheet folding method.

An aspect of a sheet folding apparatus includes a fold unit which folds a center of a sheet bundle to form a fold line, and a reinforce roller which moves along the fold line while applying pressure to the fold line to reinforce the fold line, wherein the reinforce roller includes plural sub-rollers which are concentrically coupled to each other in a rotation axis direction, and the respective sub-rollers apply different pressures to the fold line.

Further, an aspect of an image forming apparatus includes an image forming section which prints image data to sheets, a fold unit which folds a center of a sheet bundle, which includes the printed sheets, to form a fold line, and a reinforce roller which moves along the fold line while applying pressure to the fold line to reinforce the fold line, wherein, the reinforce roller includes plural sub-rollers which are concentrically coupled to each other in a rotation axis direction, and the respective sub-rollers apply different pressures to the fold line.

Furthermore, an aspect of a sheet folding method includes forming a fold line by folding a center of a sheet bundle by a fold unit, and reinforcing the fold line by moving a reinforce roller, wherein plural sub-rollers are concentrically coupled to each other in a rotation axis direction and the respective sub-rollers apply different pressures to the fold line, along the fold line while applying pressure to the fold line.

DESCRIPTION OF THE DRAWINGS

In the accompanying drawings:

FIGS. 12A to 12D are views showing a reinforce roller (first embodiment) of the invention, and the concept of a sheet folding method using the reinforce roller;

DETAILED DESCRIPTION

Embodiments of a sheet folding apparatus, an image forming apparatus using the same, and a sheet folding method will be described with reference to the accompanying drawings.

(1) Structure of the Image Forming Apparatus and the Sheet Folding Apparatus

Figure 1:
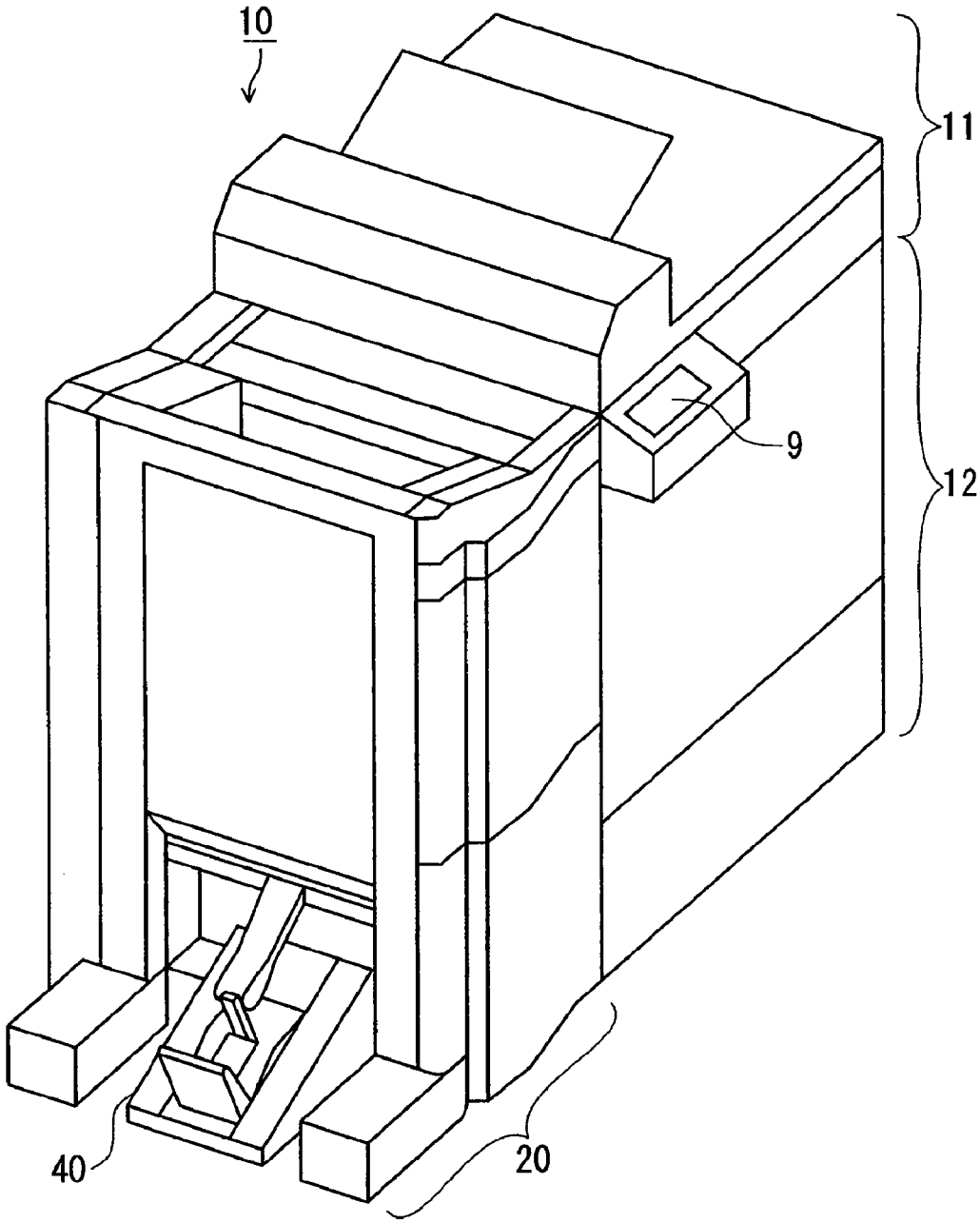
FIG. 1 is a perspective view showing an outer appearance example of an image forming apparatus of an embodiment.

FIG. 1 is an outer appearance perspective view showing a basic structural example of an image forming apparatus 10. The image forming apparatus 10 includes a read section 11 to read an original document, an image forming section 12 to print image data of the read original document to a sheet by an electrophotographic system, and a sheet finisher 20 to perform finishing, such as sorting, punching, folding or saddle-stitching, on the printed sheet. Besides, the image forming section 12 is provided with an operation section 9 by which a user performs various operations.

Figure 2:
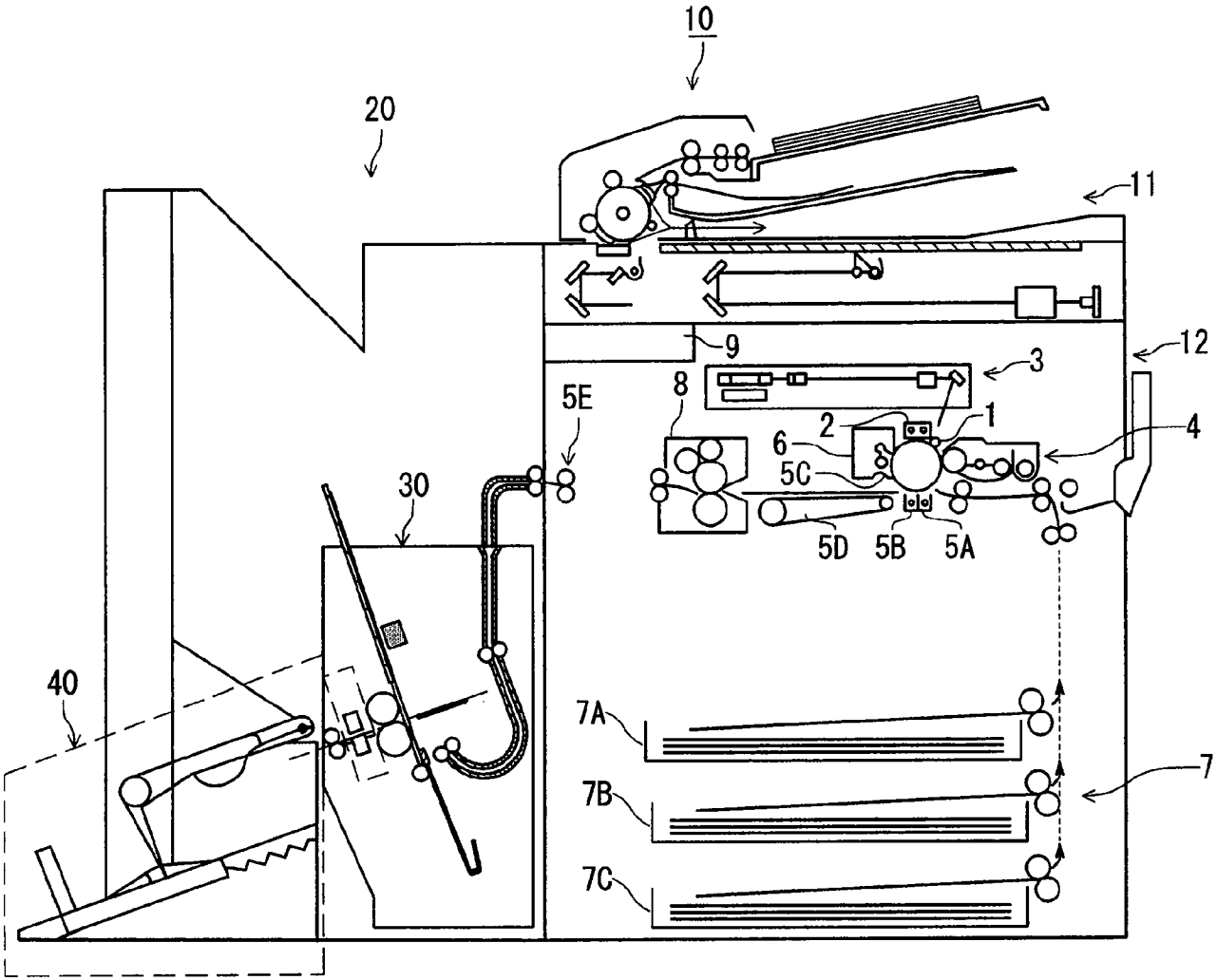
FIG. 2 is a sectional view showing a structural example of the image forming apparatus of the embodiment.

FIG. 2 is a sectional view showing a detailed structural example of the image forming apparatus 10.

The image forming section 12 of the image forming apparatus 10 includes a photoconductive drum 1 at the center thereof. A charging unit 2, an exposing unit 3, a developing unit 4, a transfer unit 5A, a charge removing unit 5B, a separating pawl 5C and a cleaning unit 6 are respectively disposed around the photoconductive drum 1. Besides, a fixing unit 8 is provided downstream of the charge removing unit 5B. These respective units perform an image forming process roughly in the following procedure.

First, the charging unit 2 uniformly charges the surface of the photoconductive drum 1. Meanwhile, the read section 11 reads an original document to convert it into image data, and outputs to the exposing unit 3. The exposing unit 3 irradiates a laser beam corresponding to the level of the image data to the photoconductive drum 1, and forms an electrostatic latent image on the photoconductive drum 1. The developing unit 4 develops the electrostatic latent image with toner supplied from the developing unit 4, forms a toner image on the photoconductive drum 1.

Some conveyance rollers convey a sheet contained in sheet feed cassettes 7A, 7B and 7C of a sheet containing section 7 to a transfer position (gap between the photoconductive drum 1 and the transfer unit 5A). At the transfer position, the transfer unit 5A transfers the toner image from the photoconductive drum 1 to the sheet by. The charge removing unit 5B erases the electric charge on the surface of the sheet after the toner image is transferred. The separating pawl 5C separates the sheet from the photoconductive drum 1. Thereafter, an intermediate conveyance section 5D conveys the sheet to a fixing unit 8. The fixing unit 8 heats and presses the sheet so that the toner image is fixed to the sheet. An ejection section 5E ejects the fixed sheet toward the sheet finisher 20.

The cleaning unit 6 disposed downstream of the separating pawl 5C removes a developer remaining on the surface of the photoconductive drum 1, and preparation is made for next image formation.

The sheet finisher 20 includes a sheet folding apparatus 30 and a sheet bundle placing section 40 in addition to a sorter section to sort the sheets.

The sheet folding apparatus 30 performs a process (saddle stitching) in which the center of a plurality of printed sheets ejected from the image forming section 12 is stitched with staples, and folds the center to form a booklet. The sheet folding apparatus 30 may, only fold a sheet bundle and load the folded sheet bundle on the sheet bundle placing section 40 without saddle stitching with staples.

Eventually, the sheet folding apparatus 30 places the booklet subjected to the saddle-stitching and folding (or folding) to the sheet bundle placing section 40.

Figure 3:
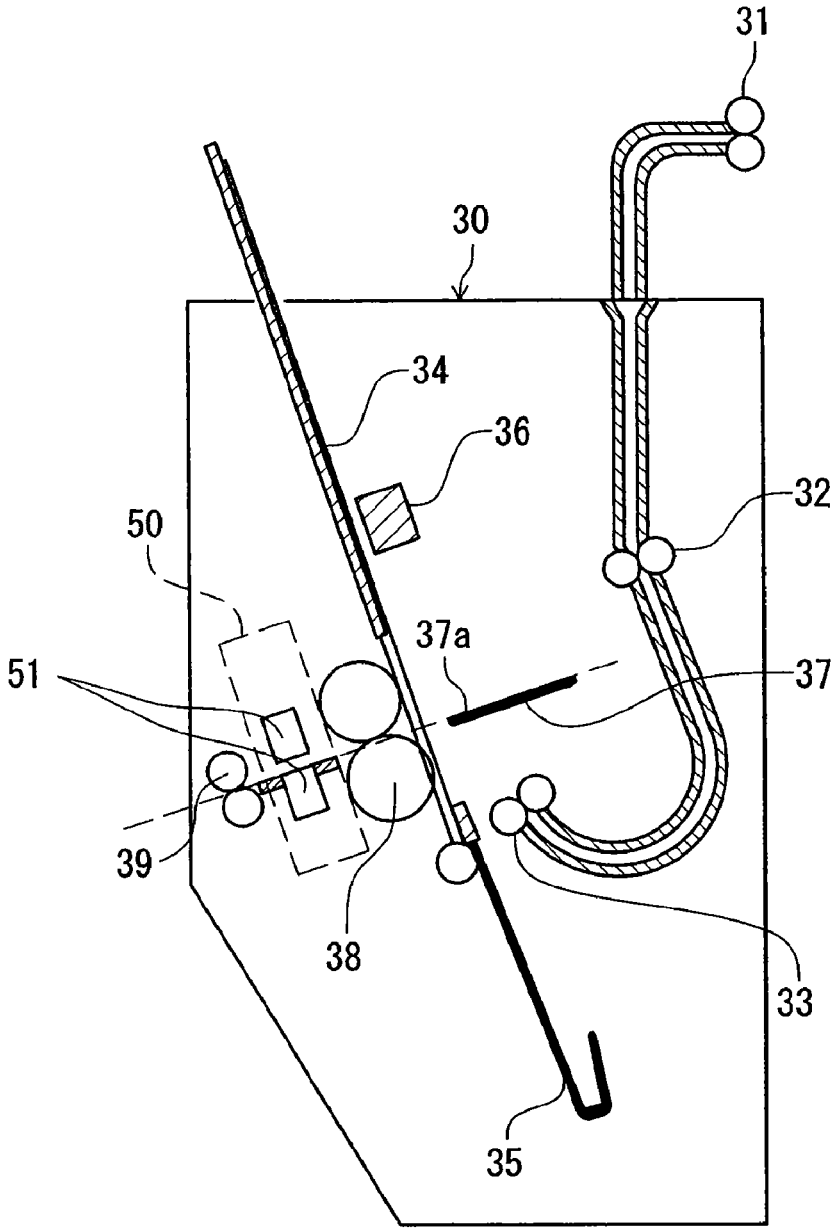
FIG. 3 is a sectional view showing a structural example of a sheet folding apparatus.

FIG. 3 is a sectional view showing a detailed structural example of the sheet folding apparatus 30.

The sheet folding apparatus 30 receives the sheet ejected from the ejection section 5E of the image forming section 12 and delivers the sheet to an intermediate roller pair 32. The intermediate roller pair 32 delivers the sheet to an outlet roller pair 33. The outlet roller pair 33 sends the sheet to a standing tray 34 having an inclined placing surface. The leading edge of the sheet is directed to the upper part of the inclination of the standing tray 34.

A stacker 35 is provided below the standing tray 34, and receives the lower edge of the sheet which is switched back and falls from the upper part of the inclination of the standing tray 34.

A stapler 36 (saddle stitch unit) is provided at the middle of the standing tray 34. When the saddle stitching (stapling) is performed on the sheet bundle, the position of the stacker 35 is adjusted so that the position of the sheet bundle to be stapled (the center of the sheet bundle in the up-and-down direction) faces the stapler 36.

After the sheet bundle is stapled by the stapler 36, the stacker 35 descends until the position of the sheet bundle where a fold line is to be formed (the center of the sheet bundle in the up-and-down direction and the position where the staples are inserted) comes to the front of a fold blade 37.

When the position where the fold line is to be formed comes to the front of the fold blade 37, a leading edge 37*a* of the fold blade 37 pushes a surface which becomes an inner surface after the sheet bundle is folded.

A fold roller pair 38 is provided ahead of the fold blade 37 in the traveling direction. The fold roller pair 38 nips the sheet bundle pushed by the fold blade 37, and forms a fold line at the center of the sheet bundle. The fold blade 37 and the fold roller pair 38 constitute a fold unit.

The sheet bundle on which the fold line is formed by the fold roller pair 38 is conveyed to a fold reinforcing unit 50 provided downstream thereof. The sheet bundle conveyed to the fold reinforcing unit 50 is temporarily stopped there.

The fold reinforcing unit 50 includes a reinforce roller 51 (a pair of rollers including an upper roller 51*a* and a lower roller 51*b*). The reinforce roller 51 moves in the direction (direction along the line of the fold line) orthogonal to the conveyance direction of the sheet bundle while applying pressure to the fold line, and reinforces the fold line.

The sheet bundle whose fold line was reinforced by the fold reinforcing unit 50 again starts to be conveyed, is pulled by an eject roller pair 39 and is outputted to the sheet bundle placing section 40. The sheet bundle (booklet) subjected to the saddle stitching is placed on the sheet bundle placing section 40.

(2) Fold Reinforcing Unit

Figure 4:
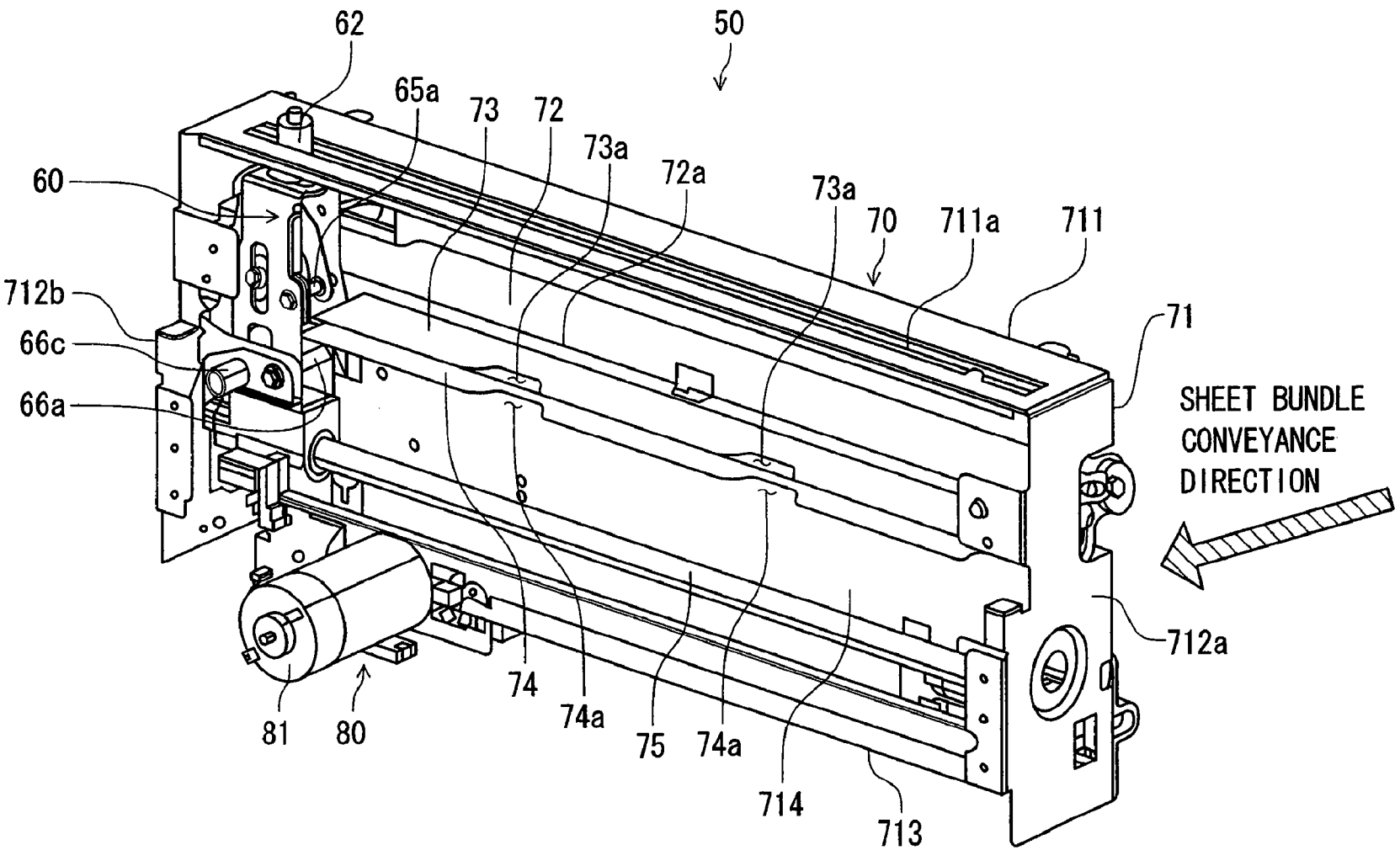
FIG. 4 is a perspective outer appearance view showing the whole structure of a reinforce unit.

FIG. 4 is a perspective outer appearance view showing the whole structure of the fold reinforcing unit 50. The fold reinforcing unit 50 includes a reinforce roller unit 60 (hereinafter simply referred to as a roller unit 60), a support section 70 and a drive section 80.

The roller unit 60 includes the reinforce roller 51, and the reinforce roller 51 nips and presses the fold line of the sheet bundle pushed out from the upstream fold roller pair 38, and moves along the fold line to reinforce the fold line.

Although the reinforce roller 51 of the embodiment has a multi-stage structure in a rotation axis direction as described later (see FIG. 12A to FIG. 12D, FIG. 13A to FIG. 13C), for convenience of the explanation, FIG. 3 to FIG. 10 schematically show that the reinforce roller has a one-stage structure.

The support section 70 supports the roller unit 60 so that the roller unit slides in the fold line direction, and includes a member of nipping the sheet bundle, a structural member of the whole fold reinforcing unit 50, and the like.

The drive section 80 includes a drive motor 81, and drives the roller unit 60 along the fold line by the drive motor 81.

Figure 5B:
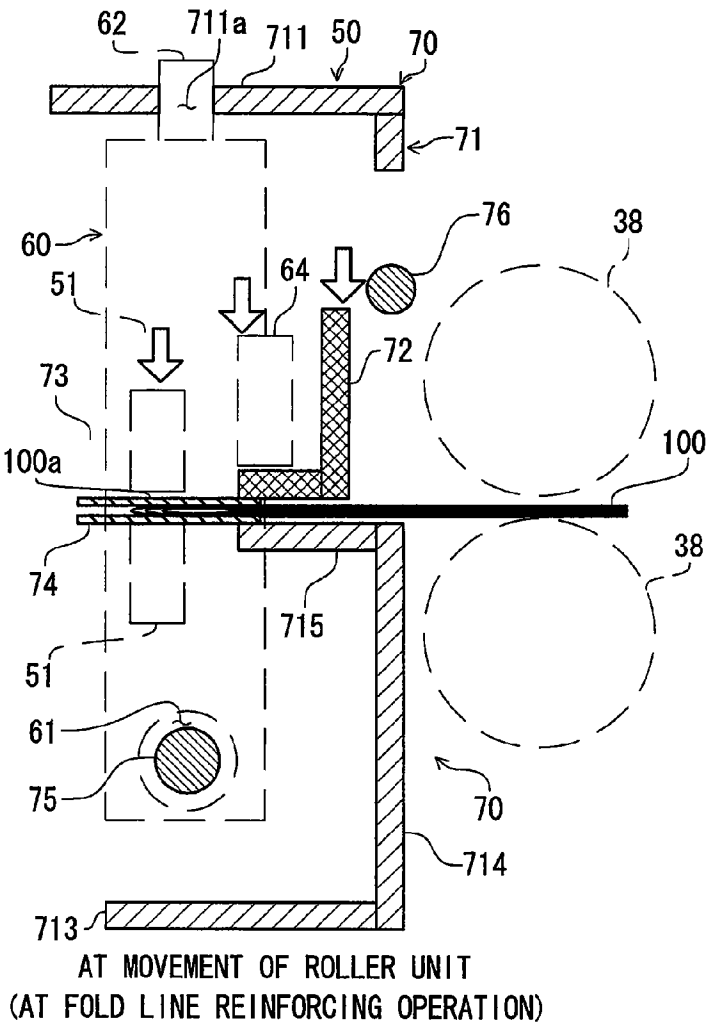
FIGS. 5A and 5B are schematic sectional views for mainly explaining a structure of a support section of the reinforce unit.
Figure 5A:
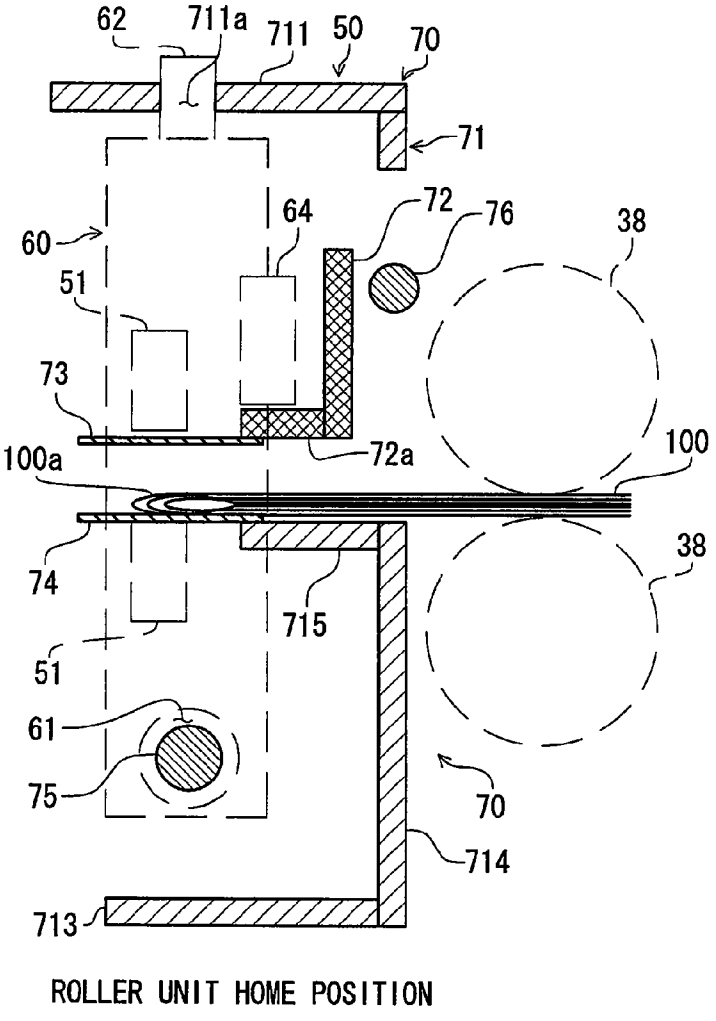

With respect to the roller unit 60, the support section 70 and the drive section 80, the structure of the support section 70 will be first described by use of FIG. 4 and FIGS. 5A and 5B. FIGS. 5A and 5B are schematic sectional views for mainly explaining the structure of the support section 70. FIG. 5A is a sectional view when the roller unit 60 is at a home position (standby position: left end position in FIG. 4), and FIG. 5B is a sectional view when the roller unit 60 moves and reinforces the fold line.

The support section 70 includes a frame 71, and the frame 71 includes a top plate 711, right and left side plates 712*a* and 712*b*, a bottom plate 713, a back plate 714, a sheet bundle placing table 715 (see FIG. 5A, FIG. 5B, etc.) and the like.

The top plate 711 has a support hole 711*a* extending in the longitudinal direction.

Besides, there exist a support shaft 75 to support the roller unit 60, a conveyance guide 72 having an L-shaped cross-section, a drive shaft 76 (see FIG. 5A, FIG. 5B, etc.) to drive the conveyance guide 72 in the up-and-down direction, and the like between both the side plates 712*a* and 712*b*.

A band-like flexible member 73 formed of a film-like resin member of polyethylene terephthalate (PET) or the like is extended from a bottom plate 72*a* of the conveyance guide 72. A similar flexible member 74 is extended also from the sheet bundle placing table 715.

As shown in FIG. 5A and FIG. 5B, the flexible members 73 and 74 nip a fold line 100*a* of a sheet bundle 100, and press the fold line to be reinforced with the reinforce roller 51 through the flexible members 73 and 74. The flexible members 73 and 74 prevent a scratch or a wrinkle in the fold line.

Cuts 73*a* and 74*b* are provided at the leading ends of the flexible members 73 and 74. These cuts 73*a* and 74*b* are provided at positions corresponding to positions of staples of the fold line, and prevent the flexible members 73 and 74 from being damaged by the staples.

As described later, there exists a through hole 61 through which the support shaft 75 passes in the lower part of the roller unit 60. Besides, there exists a support roller 62 for keeping the attitude in the upper part of the roller unit 60, and the support roller 62 moves along the support hole 711*a* in the top plate 711.

The position (except a position change in the movement direction) of the roller unit 60 and the three-axis attitude are regulated by the support shaft 75, the through hole 61, the support hole 711*a* and the support roller 62, and are kept constant also during the movement of the roller unit 60.

Figure 6:
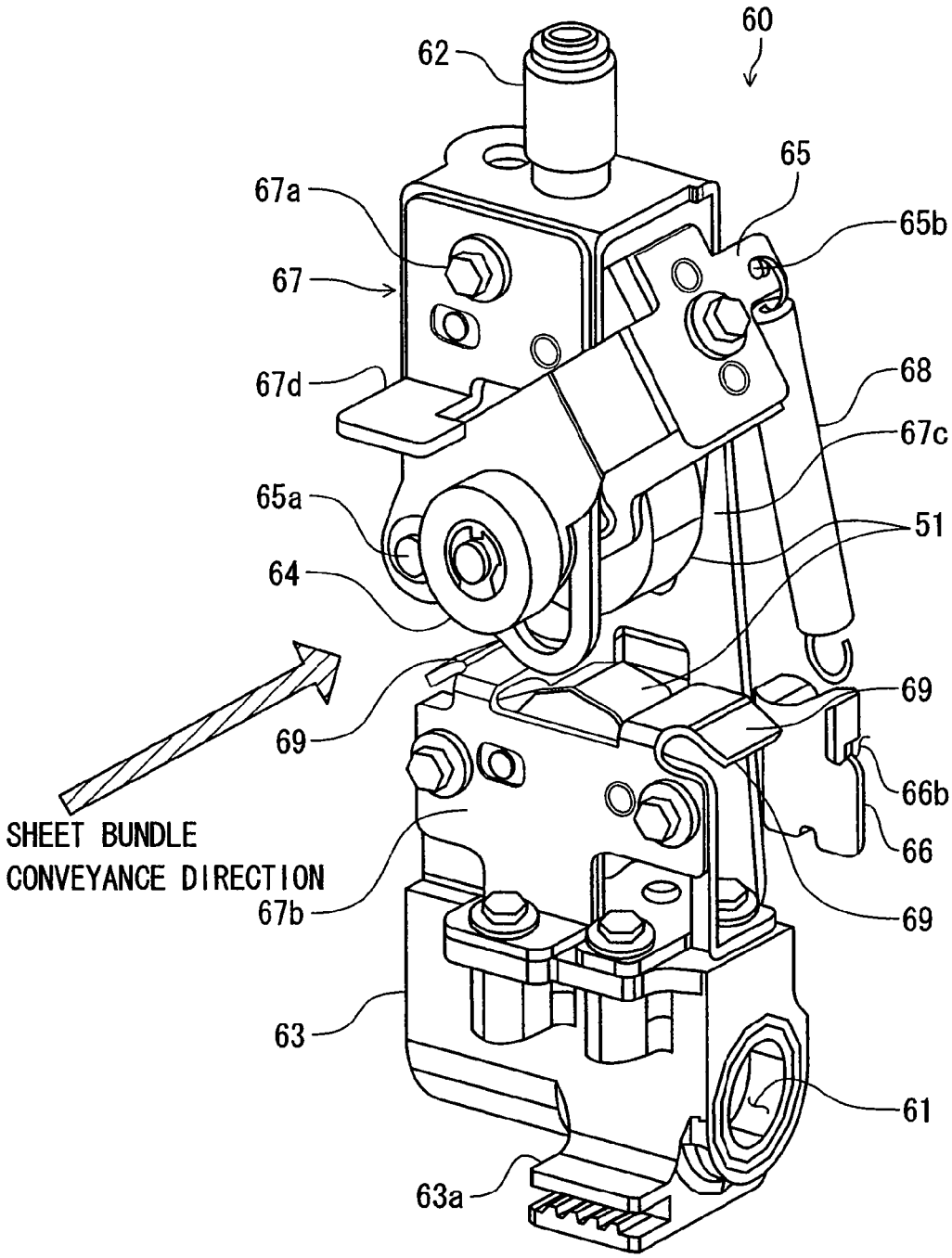
FIG. 6 is a perspective outer appearance view showing a structural example of a roller unit.

Next, the structure of the roller unit 60 will be described. FIG. 6 is a perspective outer appearance view showing a structural example of the roller unit 60, and is a view seen from the sheet bundle sending source direction (direction opposite to FIG. 4).

The roller unit 60 incorporates the reinforce roller 51. The roller unit 60 includes a unit support section 63 that is positioned at the lower part and has a through hole 61, and a unit frame 67 fixed to the upper part of the unit support section 63.

In the unit frame 67, an upper frame 67*a* having a hollow part and a lower frame 67*b* having a hollow part are fixed and coupled by a frame plate 67*c*.

The roller unit 60 also includes an upper link member 65 and a lower link member 66, and both are spring coupled by a spring 68. One end of the spring 68 is engaged with a hook hole 65*b* of the upper link member 65, and the other end of the spring 68 is engaged with a cut part 66*b* of the lower link member 66. Although FIG. 6 shows the spring 68 in a free state in which the other end of the spring 68 is released from the cut part 66*b*, the other end of the spring 68 is actually engaged with the cut part 66*b*, and the pulling force of the spring 68 is applied between the upper link member 65 and the lower link member 66.

The hollow part of the lower frame 67*b* contains the lower roller as one of the reinforce rollers 51. The lower roller is freely rotatably supported around a lower roller shaft (not shown) fixed to the lower frame 67*b*.

The lower link member 66 rotatably connects a lower link shaft 66*a* (see FIG. 4) fixed to the lower frame 67*b* to the side of the lower frame 67*b*.

The hollow part of the upper frame 67*a* contains the upper roller as the other of the reinforce rollers 51. The upper roller is freely rotatably supported around an upper roller shaft (not shown) fixed to the upper link member 65 (not the upper frame 67*a*).

The rotation shaft (lower roller shaft) of the lower roller is fixed to the lower frame 67*b* (that is, fixed to the unit frame 67), and even if the roller unit 60 moves, the position of the lower roller does not change in the up-and-down direction. The position of the lower roller is adjusted so that the upper end of the lower roller becomes the same as the position of the flexible member 74. When the roller unit 60 moves, the lower roller rotates while contacting on the lower surface of the flexible member 74.

On the other hand, the upper link member 65 connects to the upper roller shaft of the upper roller. When the roller unit 60 is separated from the home position and starts to move, the upper link member 65 is pulled by the spring 68, and starts to rotate downward around the upper link shaft 65*a*. By this rotation, the upper roller rotatably attached to the upper link member 65 starts to descend, and moves to a position where the upper roller comes in contact with the lower roller. The press force caused by the pulling force of the spring 68 is mutually exerted between the upper roller and the lower roller. Actually, since the sheet bundle is nipped between the upper roller and the lower roller through the flexible members 73 and 74, the fold line of the sheet bundle is reinforced by the press force between the upper roller and the lower roller.

Figure 7:
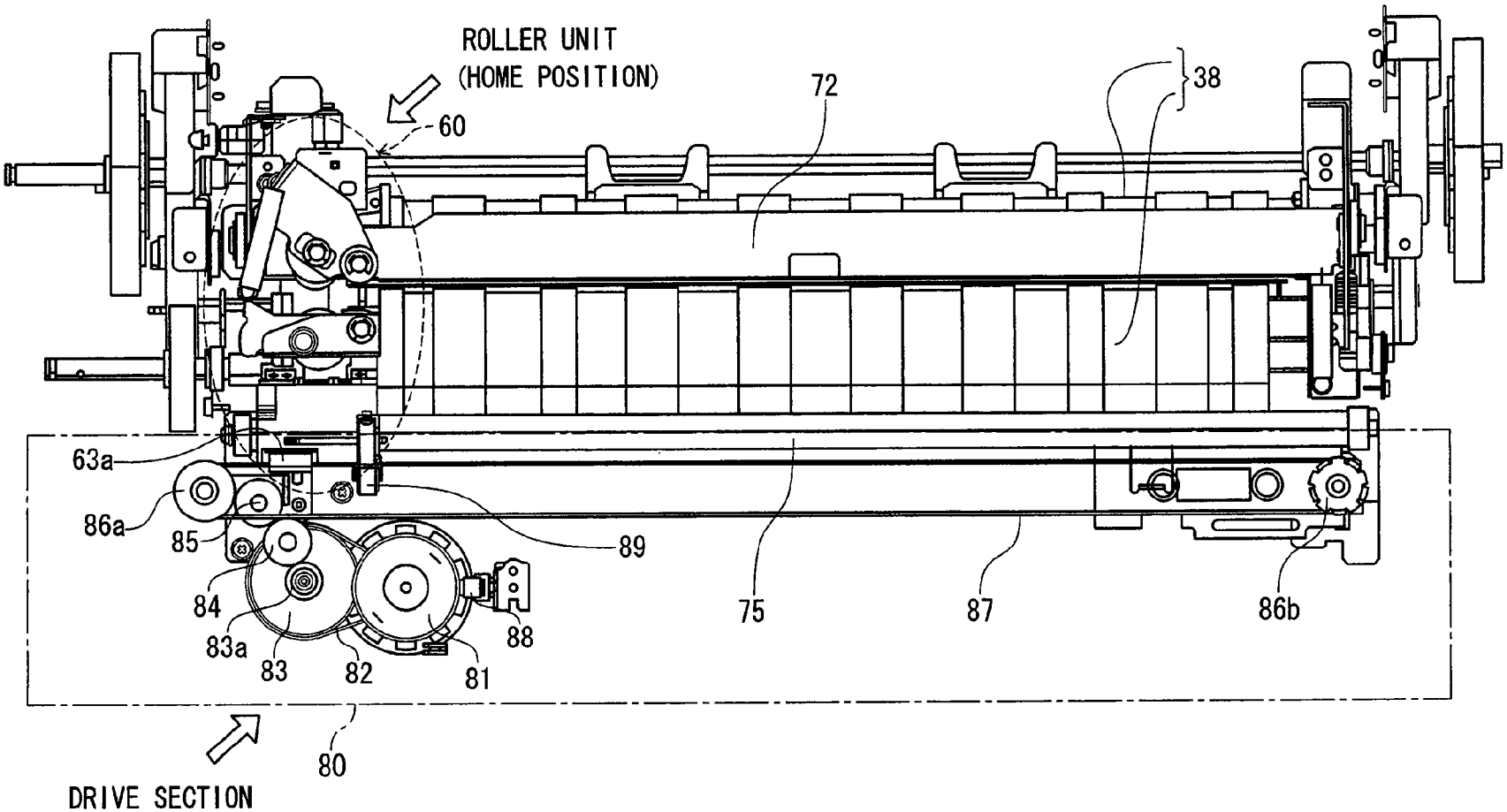
FIG. 7 is a view of the reinforce unit seen from the conveyance destination of a sheet bundle.

Next, a structure of the drive section 80 will be described. FIG. 7 is a view showing a structure of the drive section 80 and a structural example. FIG. 7 is the view seen in the direction from a conveyance destination of a sheet bundle to a conveyance source. FIG. 7 also shows the roller unit 60 at the home position, the fold roller pair 38 and the drive mechanism of the fold roller pair 38.

The drive unit 80 includes a drive motor 81 which is only one drive source of the fold reinforcing unit 50. The drive motor 81 is a DC motor, and the rotation direction and rotation speed can be controlled from outside.

A motor belt 8 transmits the drive force of the drive motor 81 to a pulley 83, and further transmits the drive force from a gear 83*a* of the pulley 83 to a drive side pulley 86*a* through a gear 84 and a gear 85. The drive side pulley 86*a* and a driven side pulley 86*b* support a unit drive belt 87. The unit drive belt 87 moves around the drive side pulley 86*a* and the driven side pulley 86*b* by the drive force of the drive motor 81.

A rack is formed on the surface of the unit drive belt 87, and the rack is engaged with teeth of a fit section 63*a* (see FIG. 6) provided at the lower part of the roller unit 60, so that the roller unit 60 can be certainly moved in the fold line direction without sliding. The movement direction of the unit drive belt 87 can be changed by reversing the rotation direction of the drive motor 81, and the roller unit 60 can be reciprocated, or can be one way moved in one of an outgoing path and a return path.

The movement amount and movement speed of the unit drive belt 87, that is, the movement amount and movement speed of the roller unit 60 can be controlled by rotation control of the drive motor 81. The rotation amount and rotation speed of the drive motor 81 is detected by a train of pulse signals outputted from an encoder sensor 88 connected to the drive motor 81, and the rotation control of the drive motor 81 is performed by detection the rotation amount and rotation speed with the encoder sensor 88.

If the drive motor 81 is a pulse motor, the rotation speed can be detected by counting the pulses directly outputted from the drive motor 81.

Figure 8:
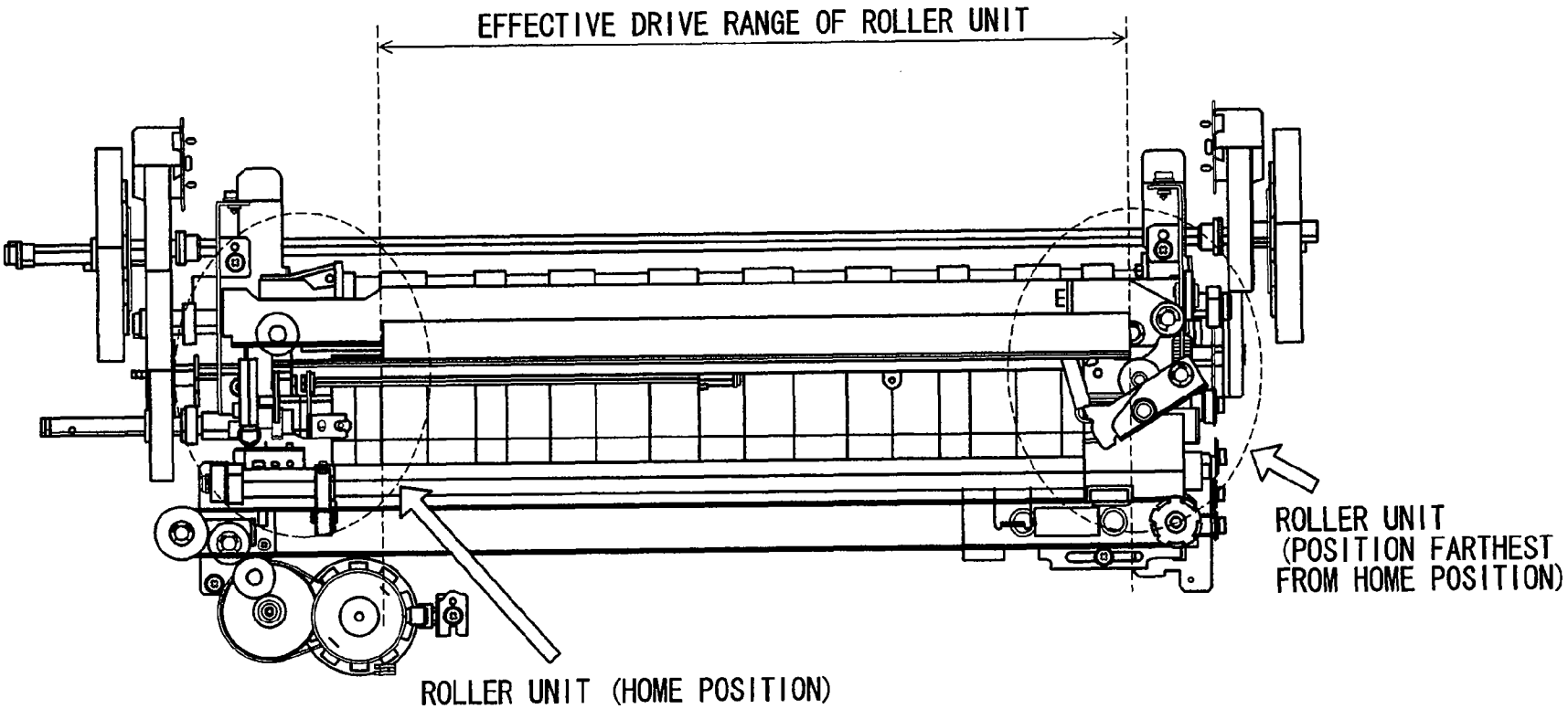
FIG. 8 is a view for explaining an effective drive range of the roller unit.

FIG. 8 is a view showing a relation between the effective drive range of the roller unit 60 and the width of a processable maximum sheet size (for example, A3 size). As shown in FIG. 8, the home position of the roller unit 60 is set at a position where even the sheet bundle of the processable maximum size does not interfere.

When reciprocating movement is performed, the roller unit 60 starts movement to separate from the home position, moves along the fold line while reinforcing the fold line, and stops at the opposite side to the home position. After stopping, the roller unit 60 starts to move on the return path while continuously reinforcing the fold line, and is returned to the home position.

The fold reinforcing unit 50 drives an up-and-down movement of the upper roller in the roller unit 60 and an up-and-down movement of the conveyance guide 72, in addition to the movement of the roller unit 60 in the fold line direction. The drive source of the up-and-down movements is also the drive motor 81. That is, all the drive operations of the fold reinforcing unit 50 are performed by the single drive motor 81. Hereinafter, the mechanism of the up-and-down drive of the upper roller will be described.

Figure 9:
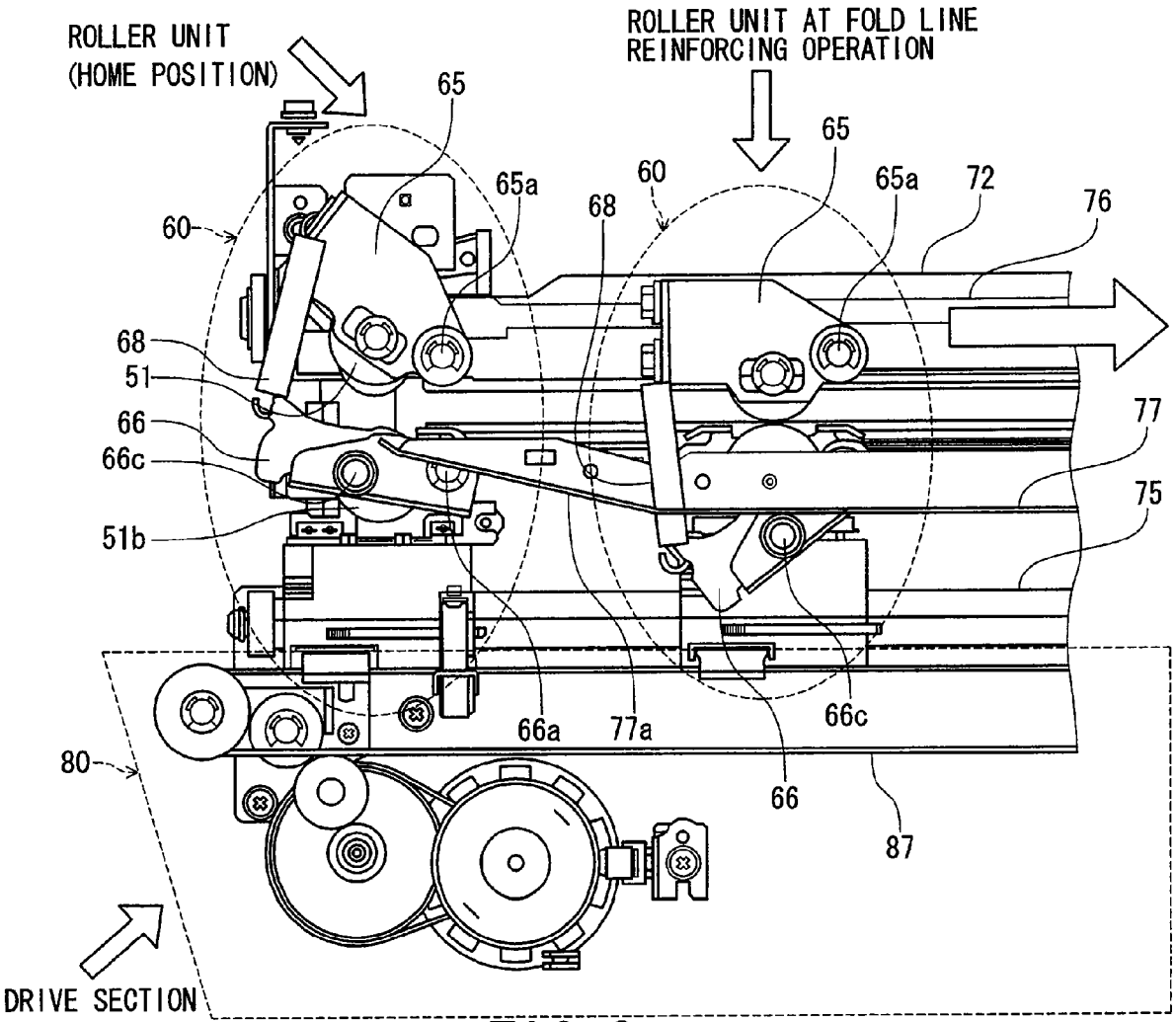
FIG. 9 is a first view for explaining the mechanism of up-and-down driving of an upper roller.
Figure 10:
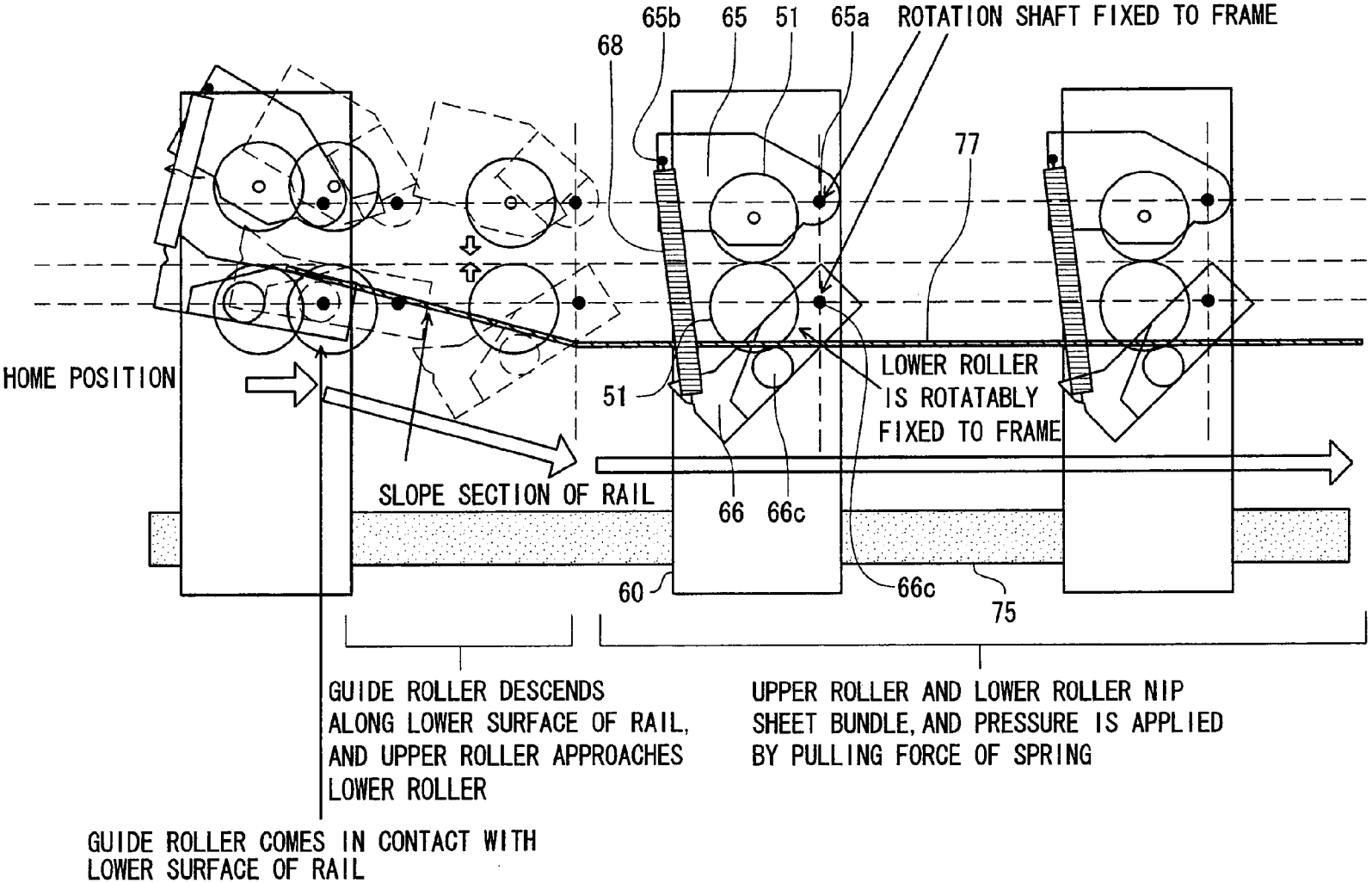
FIG. 10 is a second view for explaining the mechanism of up-and-down driving of the upper roller.

FIG. 9 and FIG. 10 are views for explaining the mechanism of the up-and-down drive of the upper roller. As described before, the spring 68 connects the upper link member 65 and the lower link member 66 of the roller unit 60 at the positions farthest from the respective rotation shafts (65*a*, 66*a*). Besides, the lower link member 66 has a freely rotating guide roller 66*c* (see FIG. 4, etc.).

Meanwhile, as shown in FIG. 9, the support section 70 includes a guide rail 77 having an L-shaped cross-section. The guide rail 77 has an inclined section 77*a*, and is parallel to the fold line direction of the sheet bundle except for the inclined section 77*a*.

When the roller unit 60 is driven by the unit drive belt 87 and is separated from the home position, as shown in FIG. 10, the guide roller 66*c* comes in contact with the bottom of the inclined section 77*a* of the guide rail 77 before long. After the guide roller 66*c* comes in contact with the bottom of the inclined section 77*a*, the guide roller 66*c* descends along the bottom of the inclined section 77*a*. As the guide roller 66*c* descends, the lower link member 66 rotates around the lower link shaft 66*a* in the counterclockwise direction in FIG. 10. Besides, the upper link member 65 is pulled by the spring 68 and rotates around the upper link shaft 65*b* in the counterclockwise direction. The upper roller between the upper link shaft 65*b* and the hook hole 65*b* of the spring 68 gradually descends while the roller unit 60 moves on the inclined section 77*a*, and the interval between the upper roller and the lower roller is gradually shortened. Then, the upper roller and the lower roller come in contact with each other in an area where the inclined section 77*a* is terminated. A pressure (pressing force) to press each other is exerted between the upper roller and the lower roller. The pressing force originates from a pulling force of the spring 68.

In a horizontal area (that is, the effective drive area) of the guide rail 77, the upper roller and the lower roller apply the pressure to the fold line of the sheet bundle and reinforce the fold line while keeping the pressing force.

(3) Reinforce Roller and Sheet Folding Method

Figure 11A:
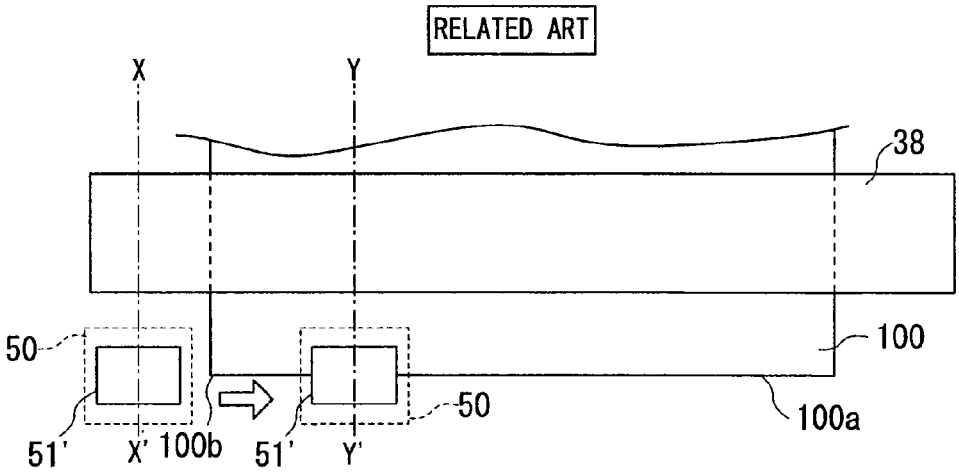
FIGS. 11A to 11C are views showing a related art reinforce roller, and the concept of a sheet folding method using the reinforce roller.
Figure 11B:
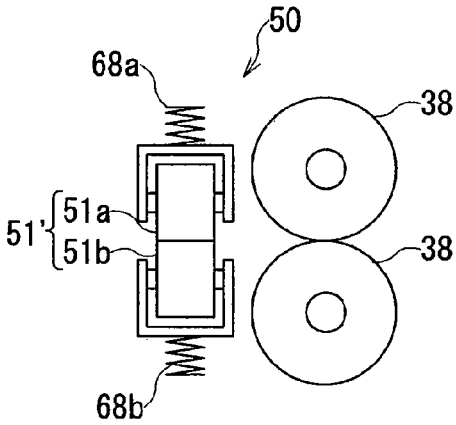
Figure 11C:
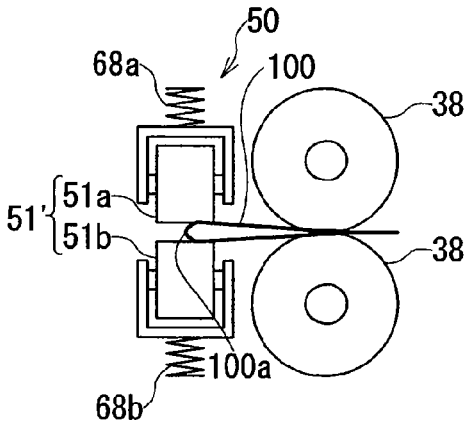

FIG. 11A to FIG. 11C are views for comparison with the reinforce roller 51 of the embodiment and showing a related art reinforce roller 51' and the concept of a sheet folding method using the reinforce roller 51'. FIG. 11A is a view showing a positional relation between the fold roller pair 38, the reinforce roller 51' and the sheet bundle 100, and is a view in which these are seen from above. FIG. 11B and FIG. 11C are an X-X' sectional view and a Y-Y' sectional view of FIG. 11A, respectively.

FIG. 9, FIG. 10 and the like show the state in which the pressing force caused by the pulling force of the spring 68 is mutually exerted between the reinforce roller 51 (the upper roller 51*a* and the lower roller 51*b*), and the fold line of the sheet bundle is reinforced by the pressure of the pressing force. On the other hand, FIG. 11B and FIG. 11C show a method of mutually pressing the reinforce roller 51' (the upper roller 51*a* and the lower roller 51*b*) by an upper spring 68*a* and a lower spring 68*b* (the same applies to FIG. 12B to FIG. 12D and FIG. 13A to FIG. 13C described later).

Although this is mainly for convenience of explanation, the reinforce roller 51' may be actually pressed by the upper spring 68*a* and the lower spring 68*b*.

As described before, as the pressure of the reinforce roller becomes large, an excellent fold line can be formed even for the thick sheet bundle 100. However, in the related art reinforce roller 51', when the reinforce roller climbs over an edge 100*b* (see FIG. 11A) of a fold line of a sheet bundle, and when the pressure of the reinforce roller 51' is made excessively high, there occurs an undesirable phenomenon that the reinforce roller 51' stops at the edge 100*b* of the sheet bundle or damages the edge 100*b* of the sheet bundle. Besides, when the pressure of the reinforce roller 51' is high, when the reinforce roller climbs over the edge 100*b* of the sheet bundle in an outgoing path or drops to the outside area of the sheet bundle in a return path, an un-neglectable impact sound can occur.

In order to remove such an undesirable phenomenon of the related art, in the reinforce roller 51 of the embodiment, plural sub-rollers are concentrically coupled to each other in a rotation axis direction, and the respective sub-rollers are constructed to apply different pressures to the fold line of the sheet bundle. Specifically, the plural sub-rollers different from each other in diameter or elastic modulus are coupled in a multi-stage, and the fold line of the sheet is sequentially pressed by the respective sub-rollers, so that different pressures from a low pressure to a high pressure are applied to the fold line stepwise.

FIG. 12A to FIG. 12D show an example (first embodiment) in which the reinforce roller 51 include two-stage sub-rollers (a first sub-roller 52 and a second sub-roller 53) different from each other in diameter. The diameter of the second sub-roller 53 (the diameter of an upper sub-roller 53*a* and that of a lower sub-roller 53*b*) is smaller than the diameter of the first sub-roller 52 (the diameter of an upper sub-roller 52*a* and that of a lower sub-roller 52*b*). Each of the sub-rollers 52 and 53 is made of, for example, POM (polyoxymethylene) resin.

FIG. 12A is a plane view seen from above similarly to FIG. 11A. FIG. 12B, FIG. 12C and FIG. 12D are a X-X' sectional view, a Y-Y' sectional view and a Z-Z' sectional view of FIG. 12A, respectively. Besides, <1> to <4> in FIG. 12A are numbers indicating the rough sequence of the operation.

When the roller unit 50 moves away from the home position and approaches the sheet bundle 100, the upper sub-rollers 52*a* and 53*a* approach the lower sub-rollers 52*b* and 53*b*, and the first sub-rollers 52 having the large diameter contact with each other before the edge 100*b* of the sheet bundle (FIG. 12B). Although a high pressing force caused by the springs 68*a* and 68*b* is applied to the first sub-roller 52, the second sub-rollers 53 (53*a*, 53*b*) having the small diameter are separate from each other in a state where a gap corresponding to a difference between the diameters remains.

Meanwhile, after the fold line 100*a* is formed by the fold roller pair 38, the sheet bundle 100 is conveyed by the fold roller pair 38, and when the roller unit 50 moves away from the home position, the fold line 100*a* stops at a position where it overlaps with the movement path of the second sub-roller 53. The stop position of the fold line is the position corresponding to the center of the second sub-roller 53 in the rotation axis direction.

When the roller unit 50 comes to the position of the edge 100*b* of the sheet bundle, the second sub-rollers 53 nip the fold line (FIG. 12C). The diameter of the second sub-roller 53 is smaller than that of the first sub-roller 52, and the pressure applied by the second sub-roller 53 to the fold line is smaller than that of the first sub-roller 52. Thus, the second sub-roller 53 can climb over the sheet bundle 100 without exerting a large force on the edge 100*b* of the sheet bundle, and does not damage the edge 100*b* of the sheet bundle.

The gap between the second sub-rollers 53 is set to be smaller than the thickness of the sheet bundle whose fold line is to be reinforced. Thus, when the second sub-rollers 53 are moved along the fold line 100*a*, the fold line of the sheet bundle conveyed from the fold roller pair 38 can be reinforced. When the roller unit 50 passes the opposite edge 100*c* of the sheet bundle, the roller unit 50 stops. At this stage, the fold line 100*a* of the sheet bundle becomes thin as compared with the state where it is conveyed from the fold roller pair 38.

While the roller unit 50 stops, the fold roller pair 38 rotates to slightly advance the position of the fold line 100*a* of the sheet bundle, and again stops the sheet bundle at the position where the fold line 100*a* overlaps with the movement passage of the first sub-roller 52. The stop position of the fold line is the position corresponding to the center of the first sub-roller 52 in the rotation axis direction.

Thereafter, the roller unit 50 starts to move on the return path, and the first sub-roller 52 applies pressure to the fold line 100*a* to reinforce the fold line (FIG. 12D). Since the first sub-roller 52 has a diameter larger than that of the second sub-roller, the high pressing force of the springs 68*a* and 68*b* is directly applied between the first sub-rollers. Thus, the high pressure is applied to the fold line 100*a* of the sheet bundle, and an excellent sharp fold line can be formed. When the roller unit 50 moves in the return path direction and climbs over the opposite edge 100*c* of the sheet bundle, the high pressure is also similarly applied. However, since the thickness of the sheet bundle is reduced by the fold line reinforcement on the outgoing path performed by the second sub-roller 53, the roller unit can easily climb over the edge 100*c*, and does not damage the edge 100*c* of the sheet bundle.

As stated above, in the sheet folding method of the embodiment, the pressure applied to the fold line is gradually increased at multi stages (two stages in the example). Accordingly, the excellent sharp fold line can be formed while the edges 100*b* and 100*c* of the sheet bundle at both sides are not damaged and the movement of the roller unit 50 is not interrupted by the edges 100*b* and 100*c*.

Figures 13A, 13B, 13C:
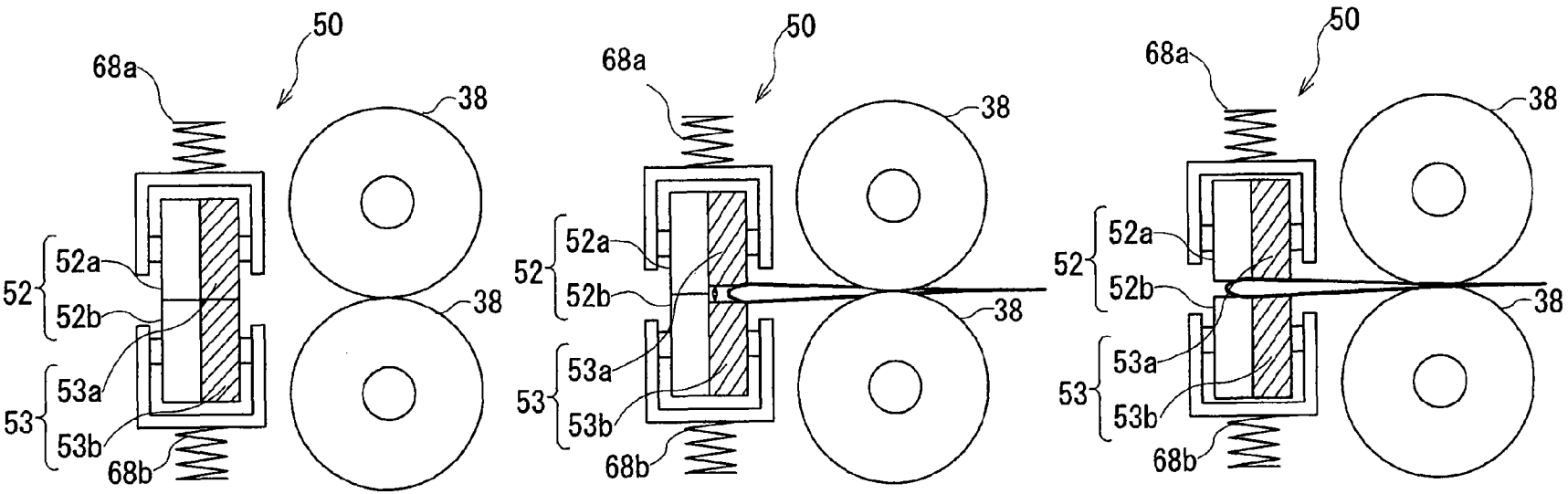
FIGS. 13A to 13C are views showing a reinforce roller (second embodiment), and the concept of a sheet folding method using this reinforce roller.

FIG. 13A to FIG. 13C show an example (second embodiment) in which the whole sub-rollers (a first sub-roller 52 and a second sub-roller 53) of a reinforce roller 51 or the roller surfaces are respectively formed of members different from each other in elastic modulus. The member of the second sub-roller 53 (member of an upper sub-roller 53*a* and that of a lower sub-roller 53*b*) is formed of the member having an elastic modulus smaller than that of the member of the first sub-roller 52 (member of an upper sub-roller 52*a* and that of a lower sub-roller 52*b*). For example, the second sub-roller 53 is formed of a POM resin, and the first sub-roller 52 is made of a metal.

FIG. 13A, FIG. 13B and FIG. 13C are sectional views corresponding to an X-X' cross-section, a Y-Y' cross-section and a Z-Z' cross-section of FIG. 11A, respectively.

Since the second sub-roller 53 is formed of the member having the small elastic modulus, for example, the POM resin, when the fold line is reinforced by the second sub-roller 53, the second sub-roller 53 is contracted in the thickness direction of the sheet bundle, as schematically shown in FIG. 13B, and a pressing force of springs 68*a* and 68*b* is absorbed by this contraction. Thus, the pressure applied to the fold line by the second sub-roller 53 is smaller than the pressure applied to the fold line by the first sub-roller 53, and even when the second sub-roller climbs over the edge 100*b* of the sheet bundle in the outgoing path, damage is not applied to the sheet bundle.

On the other hand, the first sub-roller is made of the member having the large elastic modulus, for example, the metal, the high pressing force of the springs 68*a* and 68*b* is directly applied to the fold line 100*a* through the first sub-roller, and an excellent and sharp fold line can be formed. Similarly to the first embodiment, the thickness of the sheet bundle is reduced by the fold line reinforcement in the outgoing path. Thus, when the first sub-roller 52 climbs over the opposite edge 100*c* of the sheet bundle in the return path, it can easily climb over the edge 100*c* without damaging the edge 100*c*.

Figure 14:
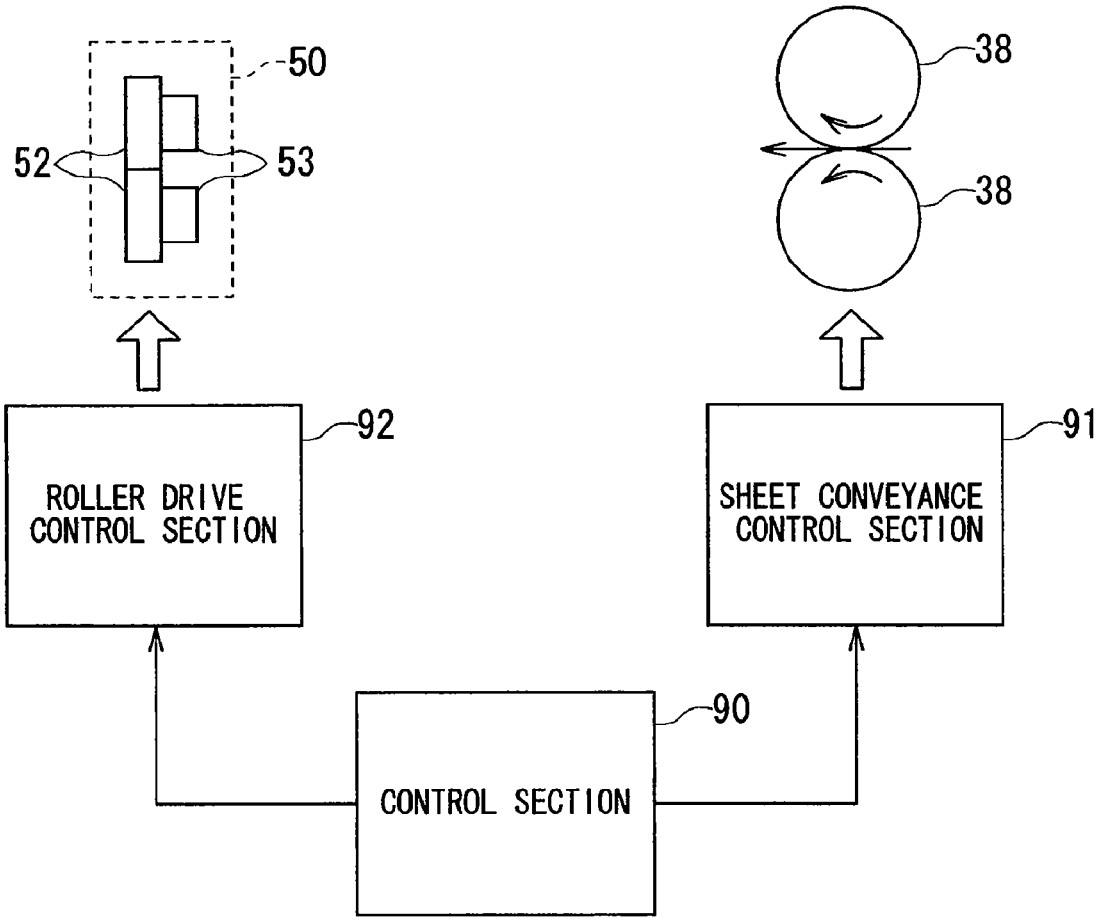
FIG. 14 is a function block diagram showing a structural example of driving of a roller unit and a fold roller pair in a sheet folding apparatus.

FIG. 14 is a function block diagram of the sheet folding apparatus 30 of the embodiment and particularly relates to drive control of the roller unit 50 and the fold roller pair 38.

With respect to the roller unit 50, a roller drive control section 92 controls the timing of movement start, timing of stop, movement speed, selection between reciprocating movement and one-way movement, selection between outgoing path movement and return path movement in the case of the one-way movement, and the like.

With respect to the fold roller pair 38, a sheet conveyance control section 91 controls the rotation start of the fold roller pair 38, rotation stop, rotation amount and the like. By the rotation control of the fold roller pair 38, the sheet conveyance control section 91 controls the conveyance start timing of the sheet bundle, stop timing, stop position.

A control section 90 gives general instructions of drive control of the roller unit 50 and the fold roller pair 38 to the roller drive control section 92 and the sheet conveyance control section 91.

Figure 15:
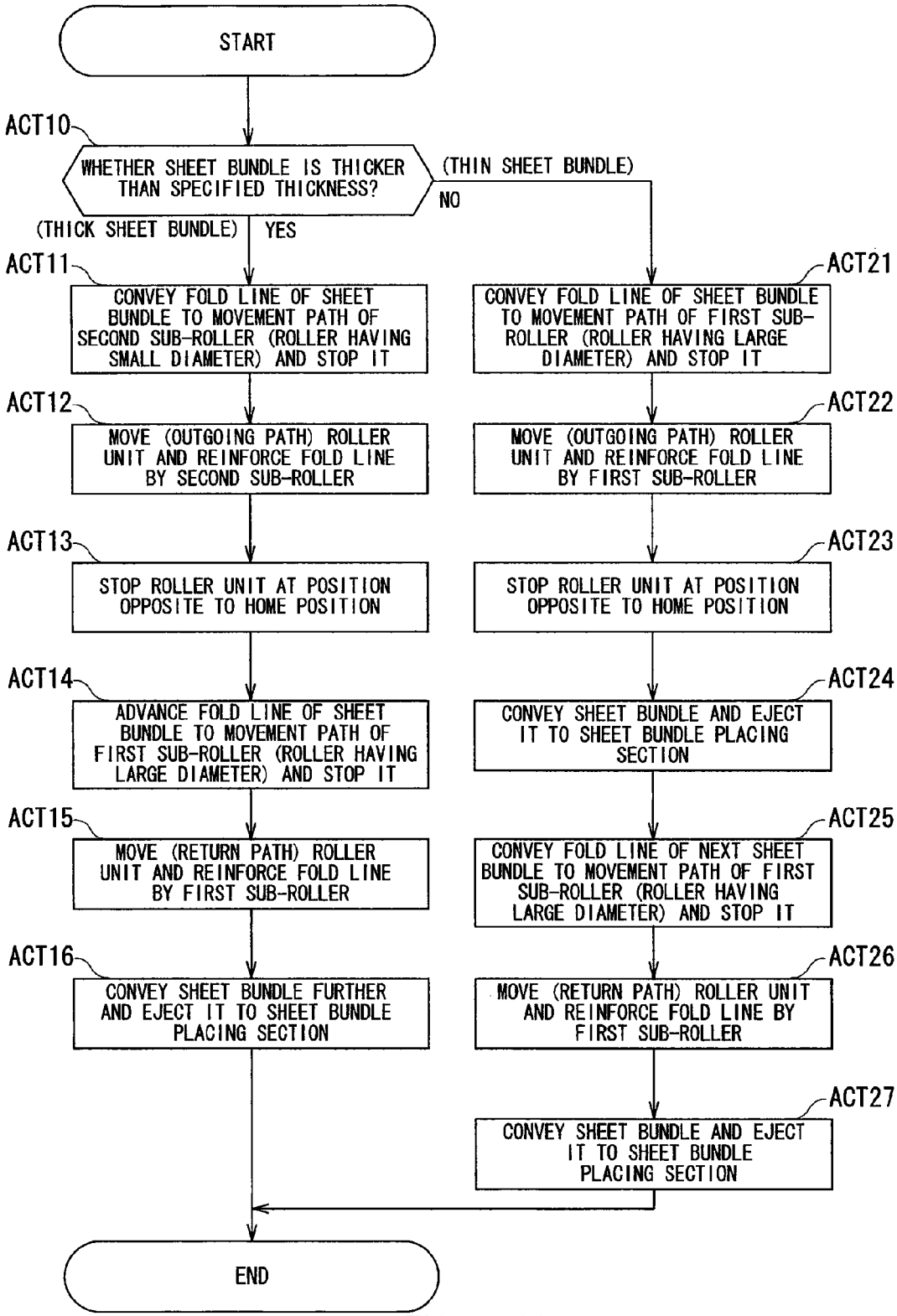
FIG. 15 is a flowchart showing an example of a sheet folding method of an embodiment.

FIG. 15 is a flowchart showing an example of the sheet folding method performed by these function blocks.

At ACT 10, it is determined whether a thickness of a sheet bundle is thicker than a predetermined thickness threshold. The determination is performed by the control section 90. The control section 90 obtains the thickness of the sheet bundle from the number of sheets constituting the sheet bundle, the thickness of each sheet, and the type of the sheet, and compares the thickness with the predetermined thickness threshold to perform the determination.

When the thickness of the sheet bundle is thicker than the predetermined thickness threshold (in the case of the thick sheet bundle), advance is made to ACT 11. When the thickness of the sheet bundle is thinner than the predetermined thickness threshold (in the case of the thin sheet bundle), advance is made to ACT 21.

At ACT 11, the fold line of the sheet bundle is conveyed to the position where it overlaps with the movement path of the second sub-roller 53 (the sub-roller having a small diameter or a small elastic modulus) and is stopped.

At ACT 12, the roller unit 50 moves on the outgoing path, and the second sub-roller 53 reinforces the fold line.

At ACT 13, the roller unit 50 stops at the outside position of the sheet bundle and at the opposite side of the home position.

At ACT 14, the fold line of the sheet bundle is advanced to the position where it overlaps with the movement path of the first sub-roller 52 (the sub-roller having a large diameter or a large elastic modulus) and is stopped.

At ACT 15, the roller unit 50 moves on the return path, and the first sub-roller 52 reinforces the fold line.

At ACT 16, the sheet bundle whose fold line is reinforced is further conveyed, and is ejected and loaded to the sheet bundle placing section 40. When there is further a thick sheet bundle, the process of ACT 11 to ACT 16 is repeated.

As stated above, in the case of the thick sheet bundle, the second and the first sub-rollers 53 and 52 reinforce the fold line stepwise in the outgoing path and the return path, and form the excellent fold line without damaging the edge of the sheet bundle.

When the thickness of the sheet bundle is further large, the second sub-roller 53 and the first sub-roller 52 may be respectively reciprocated. Besides, the number of times of the reciprocating movement and that of the one-way movement of the second and the first sub-rollers 53 and 52 are suitably selected and may be combined according to the thickness of the sheet bundle.

On the other hand, in the case of the thin sheet bundle, since there is little fear to damage the edge of the sheet bundle, only the first sub-roller 52 having the high pressure is used to reinforce the fold line. Specifically, at ACT 21, the fold line of the sheet bundle is conveyed to the position where it overlaps with the movement path of the first sub-roller 52 and is stopped.

At ACT 22, the roller unit 50 moves on the outgoing path, and the first sub-roller 52 reinforces the fold line.

At ACT 23, the roller unit 50 stops at the outside position of the sheet bundle and at the opposite side to the home position.

At ACT 24, the sheet bundle whose fold line is reinforced is further conveyed, and is ejected and loaded to the sheet bundle placing section 40.

As stated above, with respect to the thin sheet bundle, the fold line reinforcing is completed by the one-way movement of the roller unit 50.

At ACT 25, a fold line of a next sheet bundle is conveyed to a position where it overlaps with the movement path of the first sub-roller 52 and is stopped.

At ACT 26, the roller unit 50 moves in the return path, and the first sub-roller 52 reinforces the fold line of the new sheet bundle.

At ACT 27, the sheet bundle whose fold line is reinforced is further conveyed, and is ejected and loaded to the sheet bundle placing section 40. When there is further a thin sheet bundle, the process of ACT 21 to ACT 27 is repeated.

In this embodiment, since the pressure can be increased stepwise for the thick sheet bundle, even if the pressure of the finally used sub-roller (first sub-roller 52) is set to be higher than the pressure of the related art reinforce roller, there is no fear to damage the edge of the sheet bundle.

The pressure applied to the fold line of the thin sheet bundle (pressure of the first sub-roller 52) can also be set to be higher than the pressure of the related art reinforce roller. Accordingly, with respect to the thin sheet bundle, even a one-way movement is sufficient to form an excellent fold line instead of the related art reciprocating movement. With the one-way movement, a time required for the fold line reinforcement is shortened to about half.

In the respective processes shown in FIG. 15, the processes of ACT 11, 14, 16, 21, 24, 25 and 27 are mainly performed by the sheet conveyance control section 91, and the processes of ACT 12, 13, 15, 22, 23 and 26 are mainly performed by the roller drive control section 92.

(4) Punching Unit

Figure 16:
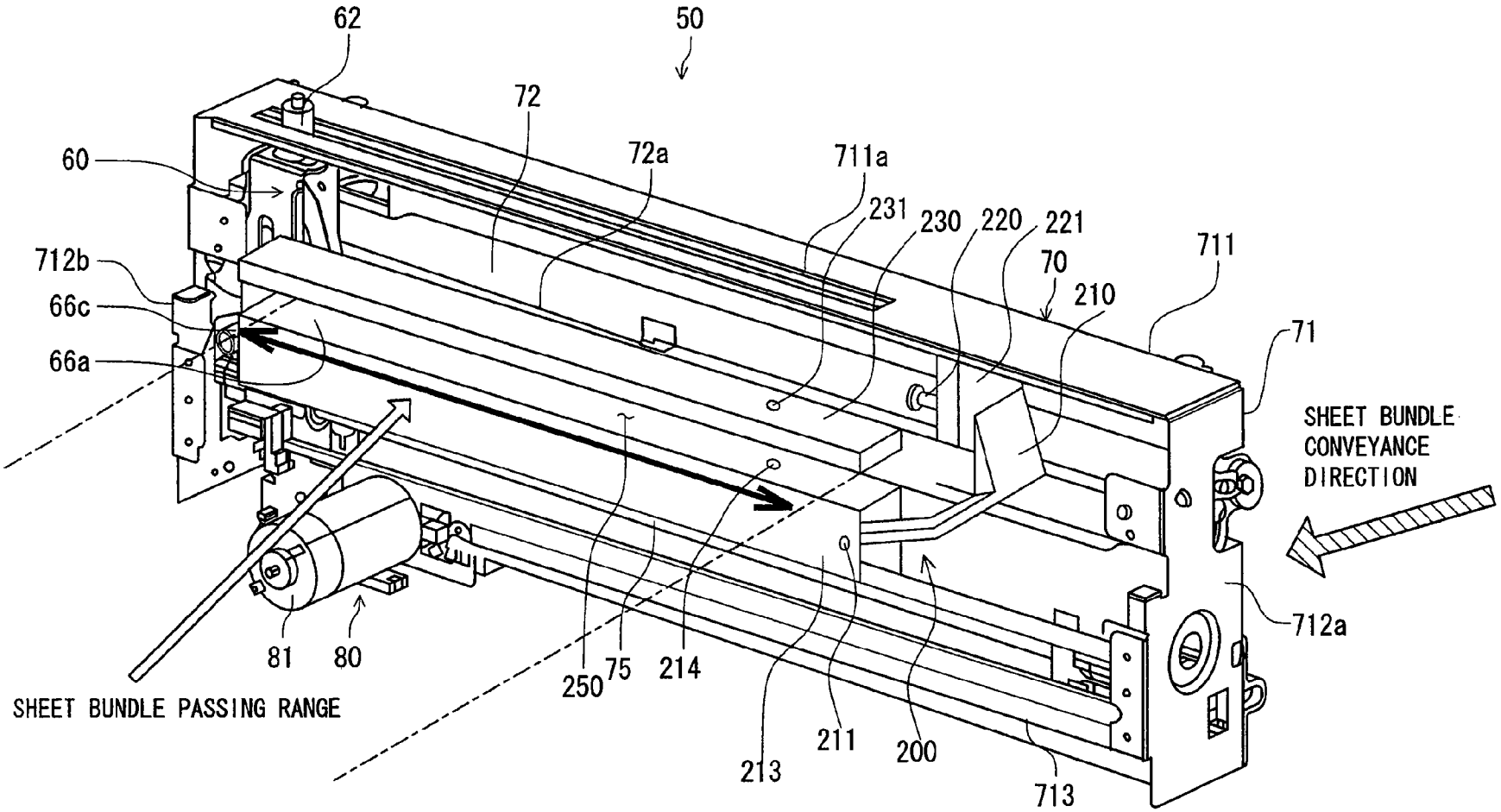
FIG. 16 is a first outer appearance view showing a structural example of a punching unit (one hole)
Figure 17:
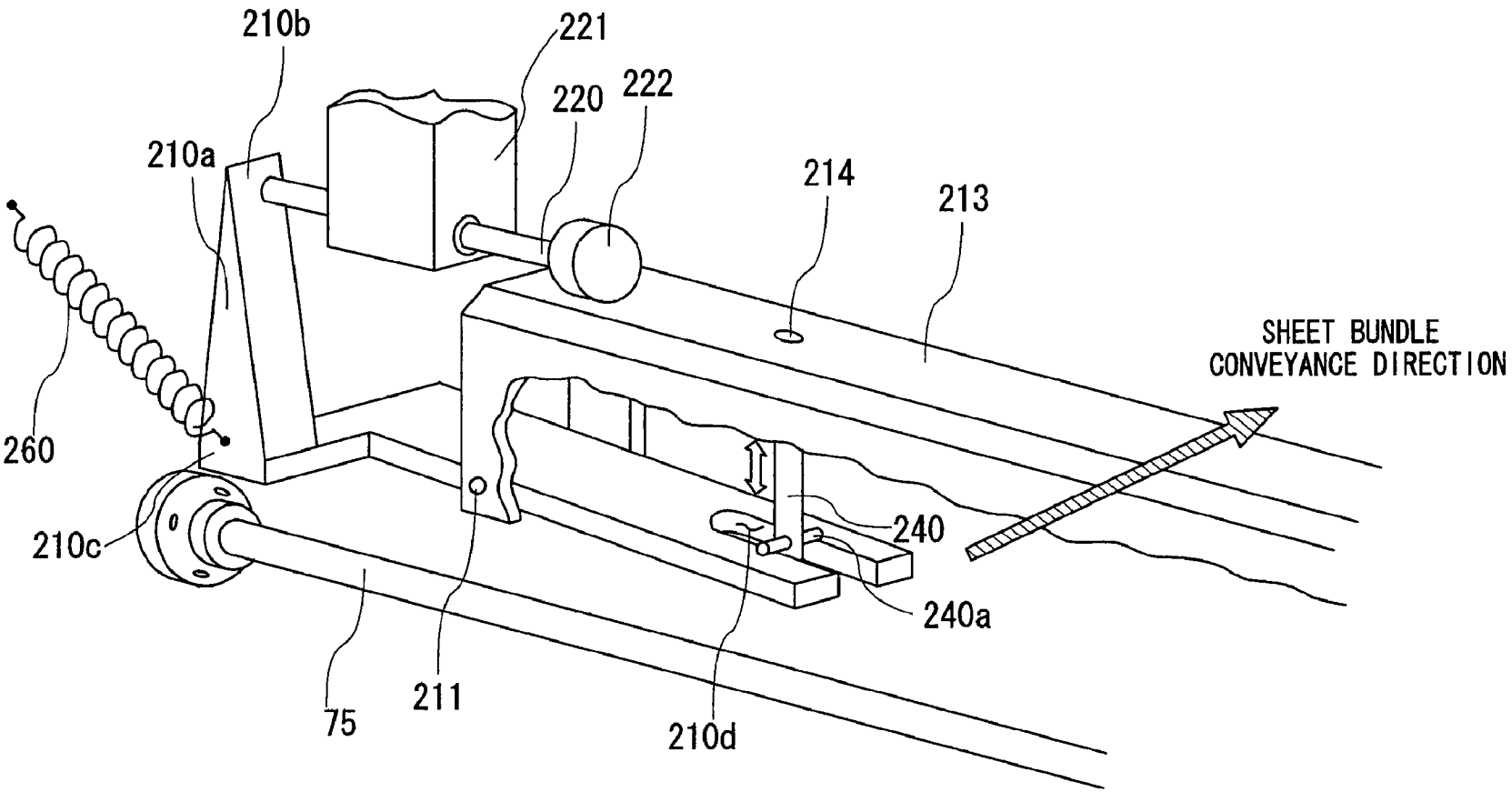
FIG. 17 is a second outer appearance view showing the structural example of the punching unit (one hole)

FIG. 16 is a view where a one-hole punching unit 200 is mounted on the fold reinforcing unit 50, and is seen from a direction of a conveyance destination of a sheet bundle. FIG. 17 is a view where the main section of the punching unit 200 is seen from a direction (conveyance source of a sheet bundle) opposite to FIG. 16.

The punching unit 200 of the embodiment uses the drive force of the roller unit 60 and punches a sheet bundle whose fold line is reinforced. After the fold line of the sheet bundle is reinforced by the outgoing path movement of the roller unit 60, the sheet bundle is slightly advanced in the conveyance direction, and then, the roller unit 60 further moves in the outgoing path direction and punches a hole in the sheet bundle whit the drive force of the roller unit 60.

First, the structure of the punching unit 200 will be described. As shown in FIG. 16, the punching unit 200 includes a lever 210, a punch cover 213, a press rod 220, a press rod support 221, a die plate 230 and the like. The lever 210 is rotatable around a lever fulcrum 211 provided on the punch cover 213, and a part of the lever 210 is contained in the inside of the punch cover 213. The punch cover 213 has a punch passing hole 214 through which a punch rod 240 passes (see FIG. 17). The die plate 230 has a die hole 231 through which the front end of the punch rod 240 passes.

As shown in FIG. 17, the press rod 220 has a cushion member 222 at the front end. The roller unit 60 presses the press rod 220 through the cushion member 222. The press rod

220 passes through the press rod support 221, and the rear end of the press rod 220 is directed to a front end 210*b* of a lever projection 210*a*.

The lever 210 is rotatably supported by the lever fulcrum 211 at the center thereof. The lever projection 210*a* extends upward from the rear end (left side in FIG. 17) of the lever 210, and one end of a lever lift spring 260 is engaged with a base of the lever projection 210*a*. The other end of the lever lift spring 260 is fixed to a frame of the fold reinforcing unit 50. The lever lift spring 260 urges the lever 210 in the clockwise direction in FIG. 17 around the lever support 211.

The front end (right side in FIG. 17) of the lever 210 has a cut 210*d*. The punch rod 240 is slidably supported along the cut 210*d* by the punch rod support 240*a*.

The operation of the punching unit 200 as constructed above will be described.

When the fold line reinforcement of the sheet bundle by the outgoing path movement is ended, the roller unit 60 temporarily stops at the outside of the sheet bundle. The sheet bundle whose fold line is reinforced is conveyed by the fold roller pair 38, enters a gap 250 formed between the lower surface of the die plate 230 and the upper surface of the punch cover 213, and stops there supported on the upper surface of the punch cover 213.

The roller unit 60 further moves in the outgoing path direction, contacts with the cushion member 222 of the press rod 220, and pushes the press rod 220 in the outgoing path direction. By this pushing, the rear end of the press rod 220 presses the front end 210*b* of the lever projection 210*a*. The lever 210 rotates around the lever fulcrum 211 (counterclockwise direction in FIG. 17) against the urging force of the lever lift spring 260, and presses the punch rod 250 upward.

By this upward pressing, the front end of the punch rod 250 rises from the punch passing hole 214 of the punch cover 213 toward the die hole 231 of the die plate 230, and punches a punch hole in the sheet bundle between the punch cover 213 and the die plate 230.

After the punch hole is punched, the roller unit 60 converts the direction from the outgoing path to the return path. When the roller unit 60 starts to move on the return path, the lever 210 is returned and rotated around the lever fulcrum 211 by the urging force (pulling force) of the lever lift spring 260 (clockwise direction in FIG. 17), and the front end of the punch rod 250 passes through the sheet bundle and is returned to the original position.

Figure 18:
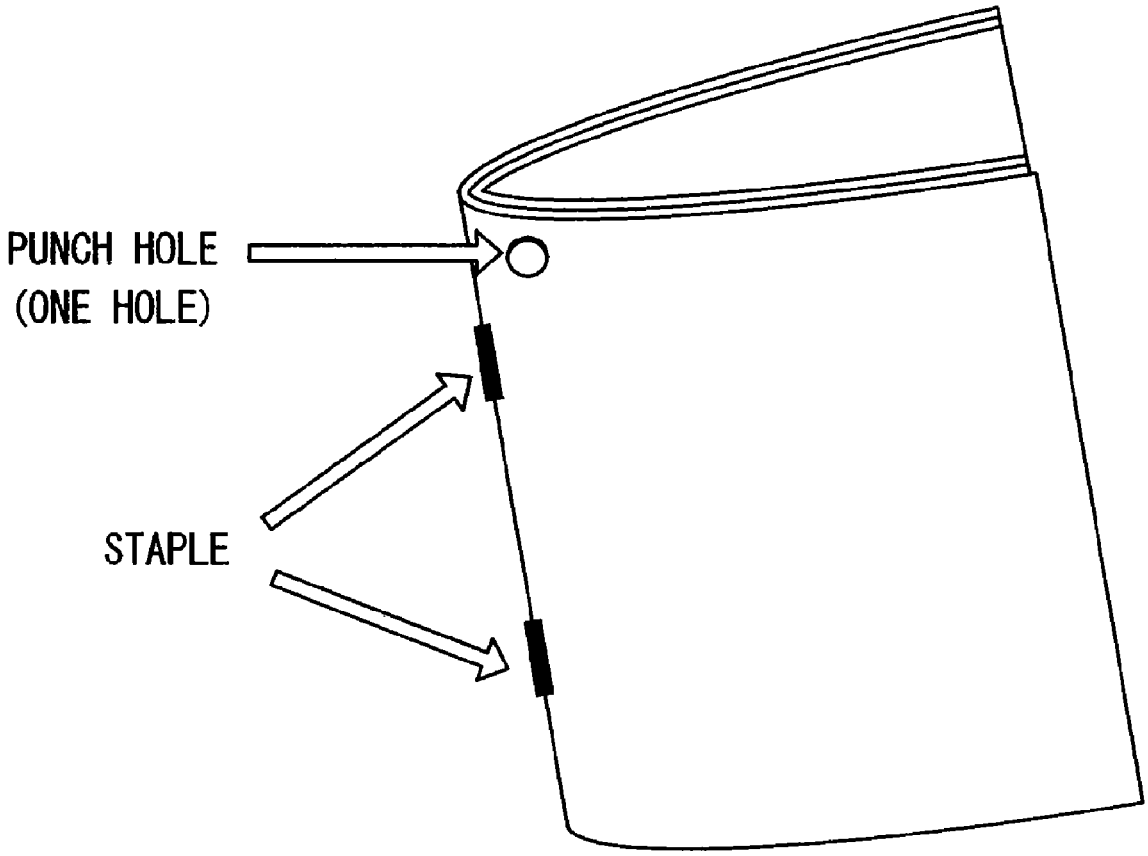
FIG. 18 is a view showing an outer appearance example of a sheet bundle punched by the punching unit (one hole)

FIG. 18 is a view showing an outer appearance example of a sheet bundle in which one punch hole is formed by the punching unit 200 of the embodiment.

Figures 19A, 19B:
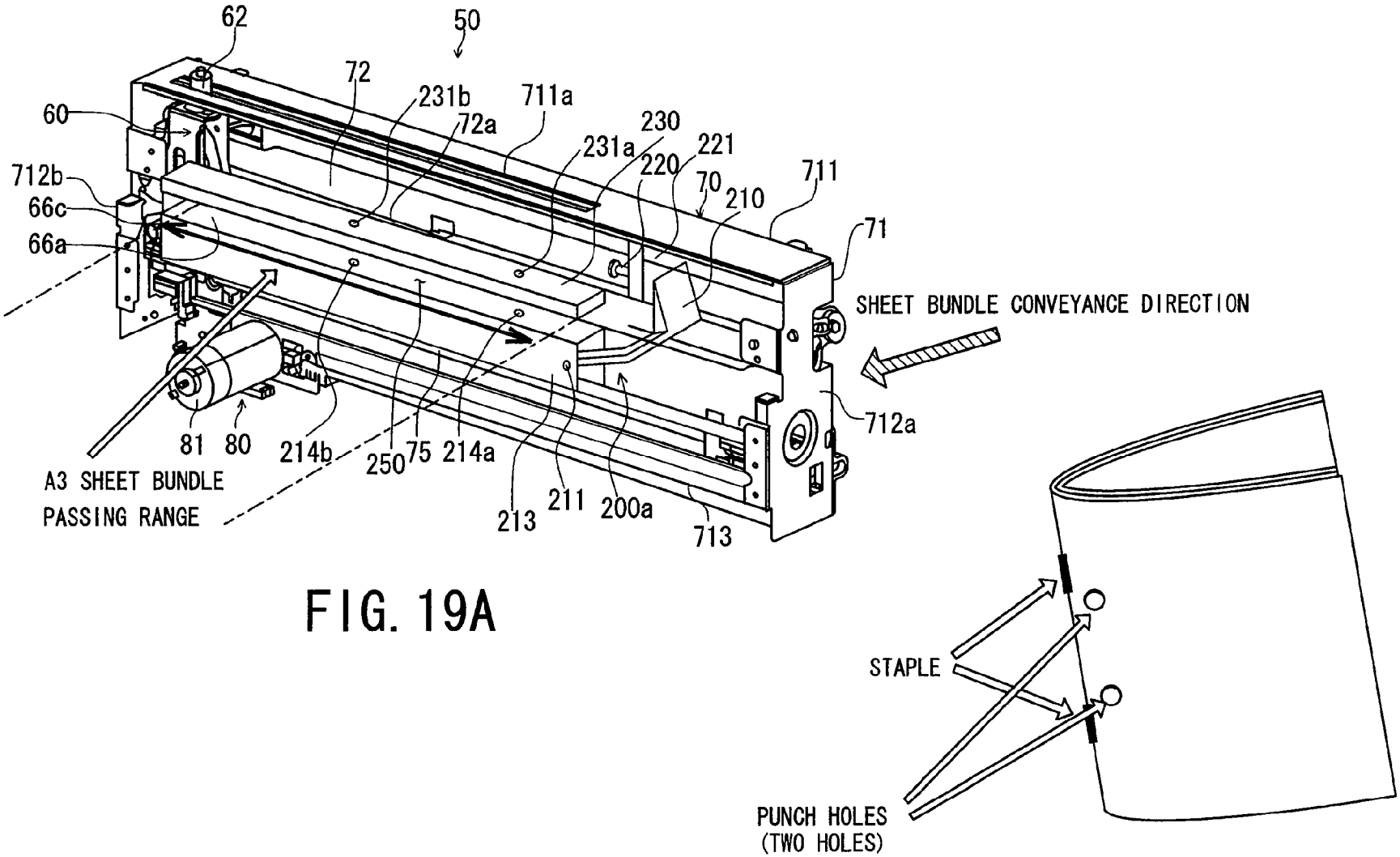
FIG. 19A is an outer appearance view showing a structural example of a punching unit (two holes)
FIG. 19B is a view showing an outer appearance example of a sheet bundle punched by the punching unit (two holes).

FIG. 19A is a view showing a structural example of a two-hole punching unit 200*a*. Besides, FIG. 19B is a view showing an outer appearance example of a sheet bundle in which two punch holes are formed by the two-hole punching unit 200*a*.

A difference between the two-hole punching unit 200*a* and the one-hole punching unit 200 is that two punch rods (illustration is omitted) are supported by a lever 210. Two punch passing holes 214*a* and 214*b* are provided in a punch cover 213 correspondingly to the two punch rods, and two die holes 231*a* and 231*b* are provided also in a die plate 230. Since the other structure and the punching operation are the same as those of the one-hole punching unit 200, their explanation is omitted.

As stated above, according to the punching units 200 and 200*a* of the embodiment, without providing a dedicated drive motor or drive control circuit, a punch hole can be formed in a sheet bundle by a simple structure in synchronization with the movement of the roller unit 60. Besides, since the punching is performed subsequently to the fold line reinforcing in the outgoing path, the whole processing time is not extended much by the punching.

When a punch hole is not required, the movement direction of the roller unit 60 has only to be changed to the return path at the position where the fold line reinforcing in the outgoing path is ended. Since the roller unit does not push the press rod 220, the punching is not performed.

As described above, according to the sheet folding apparatus 30 of the embodiment, the image forming apparatus 10 using the same, and the sheet folding method, irrespective of the thickness of the sheet bundle, an excellently reinforced fold line can be obtained without damaging the sheet bundle.

Besides, when the sheet folding apparatus 30 includes the punching unit 200 or 200*a* using the drive force of the roller unit 60, one hole or two holes can be easily formed in a booklet whose fold line is reinforced.

The embodiment of the invention is not limited to the above respective embodiments, but can be embodied while the components are modified within the scope not departing from the gist thereof at the practical phase. Besides, various embodiments can be formed by suitable combinations of plural components disclosed in the respective embodiments. For example, some components may be deleted from all components disclosed in the embodiment. Further, components in different embodiments may be suitably combined.

What is claimed is:

1. A sheet folding apparatus comprising:

a fold unit which folds a center of a sheet bundle to form a fold line; and a reinforce roller which moves along the fold line while applying pressure to the fold line to reinforce the fold line, wherein the reinforce roller includes a plurality of sub-rollers which are concentrically coupled to each other in a rotation axis direction, and the respective sub-rollers apply different pressures to the fold line.

2. The apparatus of claim 1, wherein the respective sub-rollers have different diameters.

3. The apparatus of claim 1, wherein the reinforce roller includes a first sub-roller and a second sub-roller having a diameter smaller than that of the first sub-roller, and the second sub-roller applies a pressure lower than that of the first sub-roller to the fold line.

4. The apparatus of claim 3, wherein each of the first sub-roller and the second sub-roller is made of a POM resin.

5. The apparatus of claim 1, wherein the respective sub-rollers are made of members having different elastic moduli.

6. The apparatus of claim 1, wherein the reinforce roller includes a first sub-roller and a second sub-roller made of a member having an elastic modulus smaller than an elastic modulus of a member constituting the first sub-roller, and the second sub-roller applies a pressure lower than that of the first sub-roller to the fold line.

7. The apparatus of claim 6, wherein the first sub-roller is made of a metal, and the second sub-roller is made of a POM resin.

8. The apparatus of claim 1, further comprising:

a sheet conveyance control section which conveys the sheet bundle on which the fold line is formed to a movement path of the reinforce roller from the fold unit, and stops conveyance of the sheet bundle at a position where the fold line overlaps with at least one of movement paths of the sub-rollers; and a roller drive control section which moves the reinforce roller along the fold line of the stopped sheet bundle.

9. The apparatus of claim 8, wherein the reinforce roller includes:

a first sub-roller; and a second sub-roller which is coupled to the first sub-roller at the fold unit side of the first sub-roller and applies a pressure lower than that of the first sub-roller to the fold line.

10. The apparatus of claim 9, wherein when the sheet bundle is thicker than a predetermined thickness threshold, the sheet conveyance control section stops the fold line at a position where the fold line overlaps with a movement path of the second sub-roller, the roller drive control section moves the second sub-roller while a pressure is applied to the fold line to reinforce the fold line, the sheet conveyance control section, after the second sub-roller reinforces the fold line, advances the fold line to a position where the fold line overlaps with a movement path of the first sub-roller and stops the fold line, and the roller drive control section moves the first sub-roller while a pressure is applied to the fold line to reinforce the fold line again.

11. The apparatus of claim 10, wherein the roller drive control section performs fold line reinforcement of the second sub-roller in an outgoing path movement along the fold line, and performs fold line reinforcement of the first sub-roller in a return path.

12. The apparatus of claim 10, wherein the roller drive control section performs fold line reinforcement of the second and the first sub-rollers both in reciprocating movement along the fold line.

13. The apparatus of claim 9, wherein when the sheet bundle is thinner than a predetermined thickness threshold, the sheet conveyance control section stops the fold line at a position where the fold line overlaps with a movement path of the first sub-roller, and the roller drive control section moves the first sub-roller while a pressure is applied to the fold line to reinforce the fold line.

14. The apparatus of claim 13, wherein the roller drive control section performs fold line reinforcement of the first sub-roller in one-way movement of one of an outgoing path and a return path.

15. The apparatus of claim 9, further comprising a control section to give instructions to the sheet conveyance control section and the roller drive control section, wherein depending on the number of sheets constituting the sheet bundle, a thickness of a sheet and a combination of these, the control section determines to instructs the sheet conveyance control section whether the fold line be stopped only at the position where the fold line overlaps with the movement path of the first sub-roller, or the fold line be sequentially stopped at positions where the fold line overlaps with the respective movement paths of the second sub-roller and the first sub-roller, and the control section determines to instruct the roller drive control section whether fold line reinforcement of the first and the second sub-rollers be performed in reciprocating movement, or one-way movement.

16. An image forming apparatus comprising:

an image forming section which prints image data to sheets;

a fold unit which folds a center of a sheet bundle, which includes the printed sheets, to form a fold line; and a reinforce roller which moves along the fold line while applying pressure to the fold line to reinforce the fold line, wherein the reinforce roller includes a plurality of sub-rollers which are concentrically coupled to each other in a rotation axis direction, and the respective sub-rollers apply different pressures to the fold line.

17. The apparatus of claim 16, wherein the reinforce roller includes a first sub-roller and a second sub-roller having a diameter smaller than that of the first sub-roller, and the second sub-roller applies a pressure lower than that of the first sub-roller to the fold line.

18. A sheet folding method comprising:

forming a fold line by folding a center of a sheet bundle by a fold unit; and reinforcing the fold line by moving a reinforce roller, in which a plurality of sub-rollers are concentrically coupled to each other in a rotation axis direction and the respective sub-rollers apply different pressures to the fold line, along the fold line while applying pressure to the fold line.

19. The method of claim 18, wherein the reinforce roller includes a first sub-roller and a second sub-roller which is coupled to the first sub-roller at the fold unit side of the first sub-roller and applies a pressure lower than that of the first sub-roller to the fold line, when the sheet bundle is thicker than a predetermined thickness threshold, the fold line is stopped at a position where the fold line overlaps with a movement path of the second sub-roller, the second sub-roller is moved while applying a pressure to the fold line to reinforce the fold line, the fold line is advanced, after the second sub-roller reinforces the fold line, to a position where the fold line overlaps with a movement path of the first sub-roller and is stopped, and the first sub-roller is moved while applying a pressure to the fold line to reinforce the fold line again.

20. The method of claim 18, wherein the reinforce roller includes a first sub-roller and a second sub-roller which is coupled to the first sub-roller at the fold unit side of the first sub-roller and applies a pressure lower than that of the first sub-roller to the fold line, and when the sheet bundle is thinner than a predetermined thickness threshold, the sheet conveyance control section stops the fold line at a position where the fold line overlaps with a movement path of the first sub-roller, and the roller drive control section moves the first sub-roller while a pressure is applied to the fold line to reinforce the fold line.

* * * * *